US011198309B2

(12) United States Patent
Yamamuro et al.

(10) Patent No.: US 11,198,309 B2
(45) Date of Patent: Dec. 14, 2021

(54) RECORDING APPARATUS AND METHOD IN RECORDING APPARATUS

(71) Applicant: CANON KABUSHIKI KAISHA, Tokyo (JP)

(72) Inventors: Tomoki Yamamuro, Kawasaki (JP); Toshimitsu Danzuka, Tokyo (JP); Yasunori Fujimoto, Inagi (JP); Masataka Kato, Yokohama (JP); Kazuki Narumi, Komae (JP); Shin Genta, Yokohama (JP); Kazuhiko Sato, Tokyo (JP); Kazuo Suzuki, Yokohama (JP); Hiroto Kango, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/684,307

(22) Filed: Nov. 14, 2019

(65) Prior Publication Data

US 2020/0164664 A1 May 28, 2020

(30) Foreign Application Priority Data

Nov. 27, 2018 (JP) ..... JP2018-221730

(51) Int. Cl.

| | |
|---|---|
| ***B41J 11/00*** | (2006.01) |
| ***B41J 2/17*** | (2006.01) |
| ***B41J 2/175*** | (2006.01) |
| ***B41J 2/21*** | (2006.01) |

(52) U.S. Cl.

CPC ..... *B41J 11/0065* (2013.01); *B41J 2/1721* (2013.01); *B41J 2/17566* (2013.01); *B41J 2/21* (2013.01); *B41J 2002/1742* (2013.01); *B41J 2002/17573* (2013.01)

(58) Field of Classification Search

CPC ..... B41J 11/0065; B41J 2002/1742; B41J 2002/17573; B41J 2/1721; B41J 2/16526; B41J 2/16523; B41J 2/165; B41J 2/16538; B41J 2002/16502; B41J 2/21; B41J 2/17566

See application file for complete search history.

(56) References Cited

U.S. PATENT DOCUMENTS

| | | | |
|---|---|---|---|
| 2006/0033792 | A1 | 2/2006 | Sano |
| 2018/0117907 | A1 | 5/2018 | Yamamuro |

FOREIGN PATENT DOCUMENTS

| | | | |
|---|---|---|---|
| JP | 2000-085143 | A | 3/2000 |
| JP | 2004-066553 | A | 3/2004 |
| JP | 2004-167945 | A | 6/2004 |
| JP | 2006-168177 | A | 6/2006 |

*Primary Examiner* — Kristal Feggins

(74) *Attorney, Agent, or Firm* — Canon U.S.A., Inc. I.P. Division

(57) ABSTRACT

A recording apparatus discharges an ink in a first color to a position at which an accumulated state on an ink absorber is to be detected. After that, a light is emitted onto the position from a light emitting unit, and reflected light is received by a light receiving unit.

30 Claims, 19 Drawing Sheets

RECORDING APPARATUS AND METHOD IN RECORDING APPARATUS

BACKGROUND

Field

The present disclosure relates to a recording apparatus having an ink absorber that absorbs ink discharged to the outside of a recording medium, and a method in the recording apparatus.

Description of the Related Art

Among inkjet recording apparatuses, there has been known a recording apparatus that performs marginless recording for recording an image up to an end portion of a recording medium so that no margin is formed. In a case of performing the marginless recording, an image is recorded by discharging the ink up to an outer region of an end portion of a recording medium. At this time, to protect the inside of the apparatus from being soiled by the ink discharged to the outer region of the recording medium, an absorber for absorbing the ink is disposed at a position facing a pathway on which the recording head moves.

On the other hand, preliminary discharge is known, which controls discharging of the ink to the outside of the recording medium. The preliminary discharge is performed to maintain or improve discharge performance of a discharge port on a recording head by discharging the ink that does not affect recording.

When the ink is discharged to the absorber as described above, the ink may gradually accumulates on the front surface of the absorber, because the ink dries out or is poorly absorbed into the absorber depending on the type of the ink. If the accumulation advances, the rear surface of the recording medium is soiled or a discharge port surface of the recording head is damaged due to contact between the discharge port surface and the accumulated ink.

Japanese Patent Application Laid-Open No. 2004-167945 discusses a technique of a recording apparatus provided with a detection unit including a light emitting unit and a light receiving unit. The detection unit detects a height of the ink accumulated on a scanning track of the recording head in a recording apparatus main body. The light emitting unit emits light and the light receiving unit detect the light, so that the detection unit detects the height of the accumulated ink.

Nevertheless, the following issues are raised because the wavelength of light to be absorbed varies depending on a color of the ink. For example, a black ink has absorbability of light in all the wavelength regions as long as the light has a wavelength in a visible light region. Nevertheless, for example, while a cyan ink tends to absorb light in a wavelength band of red (i.e., a complementary color of cyan), a red and yellow inks do not tend to absorb light in a wavelength band of red.

For example, in a case where the ink accumulated on the absorber is the black ink, the absorption of the black ink decreases a received light amount as compared with an amount of light received in a case of another color of ink. Thus, an accumulation state may fail to be accurately detected. On the other hand, in a case where the absorber is soiled by an ink in a color that does not tend to absorb the light emitted by the light emitting unit, the received light amount is large, and thus an accumulation state may be erroneously detected even though the accumulation state has not been reached to a predetermined accumulation state.

SUMMARY

The present disclosure is directed to preventing erroneous detection of an ink accumulation state.

According to an aspect of the present disclosure, a recording apparatus includes a recording head configured to discharge a plurality of inks in different colors, an ink absorber configured to absorb the plurality of inks discharged from the recording head, a detection unit including a light emitting unit configured to emit light onto a predetermined position of the ink absorber, and a light receiving unit configured to receive reflected light from the predetermined position on the ink absorber, a control unit configured to control the detection unit to perform a detection operation in which the light emitting unit emits light onto the predetermined position, and the light receiving unit receives reflected light from the predetermined position of the ink absorber; and a determination unit configured to determine whether to perform a predetermined operation related to ink accumulation on the absorber, based on an amount of light received from the predetermined position on the ink absorber, wherein, the control unit controls the recording head to discharge an ink in a chromatic first color among the plurality of inks to the predetermined position in response to decision to execute the detection operation by the detection unit, and controls the detection unit to perform the detection operation of the predetermined position.

Further features of the present disclosure will become apparent from the following description of exemplary embodiments (with reference to the attached drawings).

DESCRIPTION OF THE EMBODIMENTS

Hereinafter, exemplary embodiments of the disclosure will be described in detail with reference to the drawings.

Recording Apparatus Configuration

Figure 1:
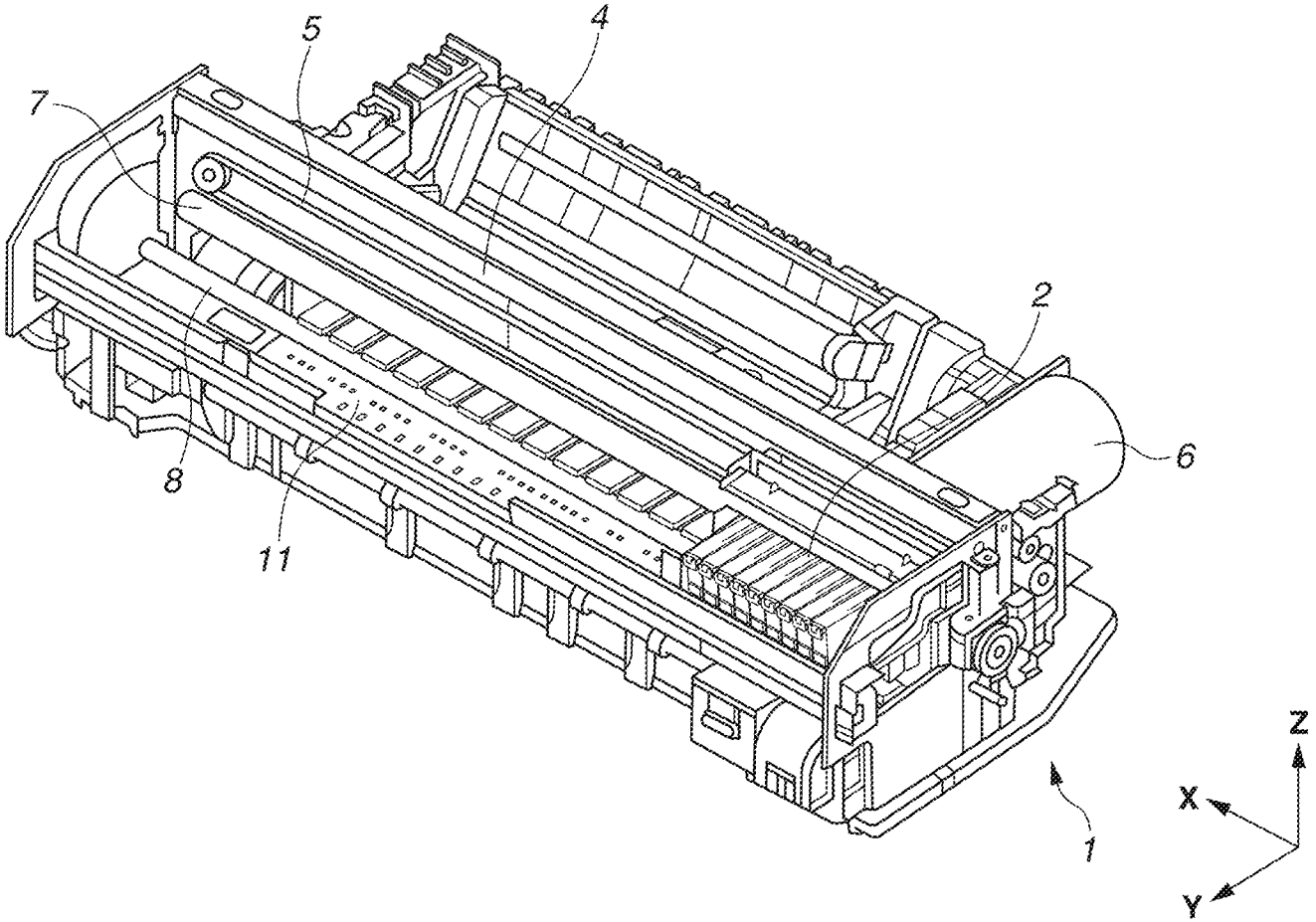
FIG. 1 is a perspective view illustrating a recording apparatus according to a first exemplary embodiment.

FIG. 1 is a perspective view illustrating an internal mechanism of an inkjet recording apparatus 1 (hereinafter, simply referred to as a recording apparatus 1) according to the present exemplary embodiment. The recording apparatus 1 according to the present exemplary embodiment mainly includes a feeding unit that feeds a recording medium, a conveyance unit that conveys a recording medium, a discharging unit that discharges a recording medium on which an image is recorded, and a recovery unit that recovers recording performance of a recording unit.

The feeding unit includes a feeding tray for stacking a plurality of recording media, and a feeding roller that feeds, one by one, recording media stacked on the feeding tray to the inside of the recording apparatus 1.

The conveyance unit includes a conveyance roller 8 that conveys a recording medium fed from the feeding unit, and a pinching roller 9 that is disposed at a position facing the conveyance roller 8 and pinches the recording medium together with the conveyance roller 8.

The recording unit includes a recording head 3 and a carriage 2. A discharge port surface formed on the recording head 3 is provided with a discharge port for discharging ink. The recording head 3 is detachably attached to the carriage 2. The carriage 2 is configured to reciprocate in an X direction (e.g., a moving direction of the carriage) along a guide shaft 7 via a timing belt 5 attached to a chassis 4, driven by a carriage motor 6. A recording medium P is conveyed in a Y direction intersecting with the X direction. While the carriage 2 is reciprocating, the recording head 3 records an image by discharging the ink to the recording medium P that stays still at a position facing the recording head 3. At the position facing the recording head 3, a platen 15 (refer to FIG. 2) that supports the recording medium from below is provided so as to keep constant a distance between the surface e.g., first surface) of the recording medium P and the discharge port surface of the recording head 3. The platen 15 is provided with an ink absorber 21 that absorbs and stores the ink discharged to an outside of the recording medium.

The discharging unit includes a discharge roller 10 (refer to FIG. 2) that discharges a recording medium on which an image is recorded to the outside of the recording apparatus, and a spur roller 11 that retains the recording medium at a position facing the discharge roller 10.

The recovery unit includes a cap 30 (refer to FIG. 5) that covers a discharge port surface 20 of the recording head 3 on the outside of a recording region along the moving direction of the carriage 2. The cap 30 includes an absorber that absorbs the ink, and covers the discharge port surface 20 by the absorber contacting the discharge port surface 20. The recovery unit further includes a suction mechanism that sucks the ink from the recording head 3 by driving a suction pump 31 connected with the cap 30 via a tube 26 in a state in which the cap 30 covers the discharge port surface 20 of the recording head 3. The recovery unit further includes a wiper 32 (refer to FIG. 5) that wipes the discharge port surface 20 of the recording head 3.

Figure 2:
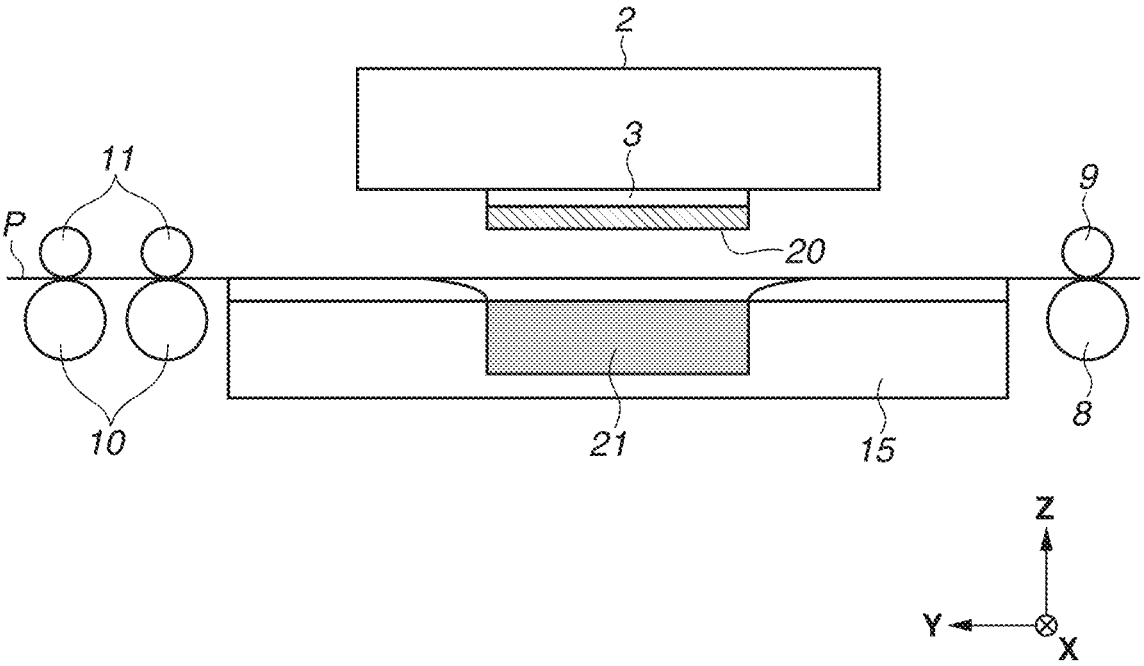
FIG. 2 is a schematic cross-sectional view of a peripheral portion of a recording unit according to the first exemplary embodiment.

Next, the configuration of a peripheral portion of recording unit will be described in detail. FIG. 2 is a schematic cross-sectional view of the peripheral portion of the recording unit according to the present exemplary embodiment, viewed in the X direction illustrated in FIG. 1, The recording medium P fed from the feeding unit is conveyed being pinched by the conveyance roller 8 and the pinching roller 9 that are provided on an upstream side of the recording head 3 in the Y direction. The recording medium P is also pinched by the discharge roller 10 and the spur roller 11 that are provided on a downstream side of the recording head 3 in the Y direction. In a state in which tensile force is generated between a pinch point of the conveyance roller 8 and the pinching roller 9 and a pinch point of the discharge roller 10 and the spur roller 11, the recording medium P is conveyed in a pinched state with a surface being kept in a flat state. The conveyed recording medium P is supported by the platen 15 from below.

On the conveyed recording medium P, an image corresponding to one band (one line break) is recorded by discharging ink droplets from the discharge port of the recording head 3 attached to the carriage 2 moving in the X direction, while the conveyance is stopped. When an image corresponding to one band is recorded, the recording medium P is conveyed in the Y direction by a predetermined amount by the conveyance roller 8 being driven by a conveyance motor (not illustrated). The reciprocating movement of the carriage 2 and the ink droplet discharge from the recording head 3, and the predetermined-mount conveyance (intermittent conveyance) of the recording medium P by the conveyance roller 8 are alternately repeated. An image is thereby recorded on the entire recording medium P.

(Recording Head)

Figure 3:
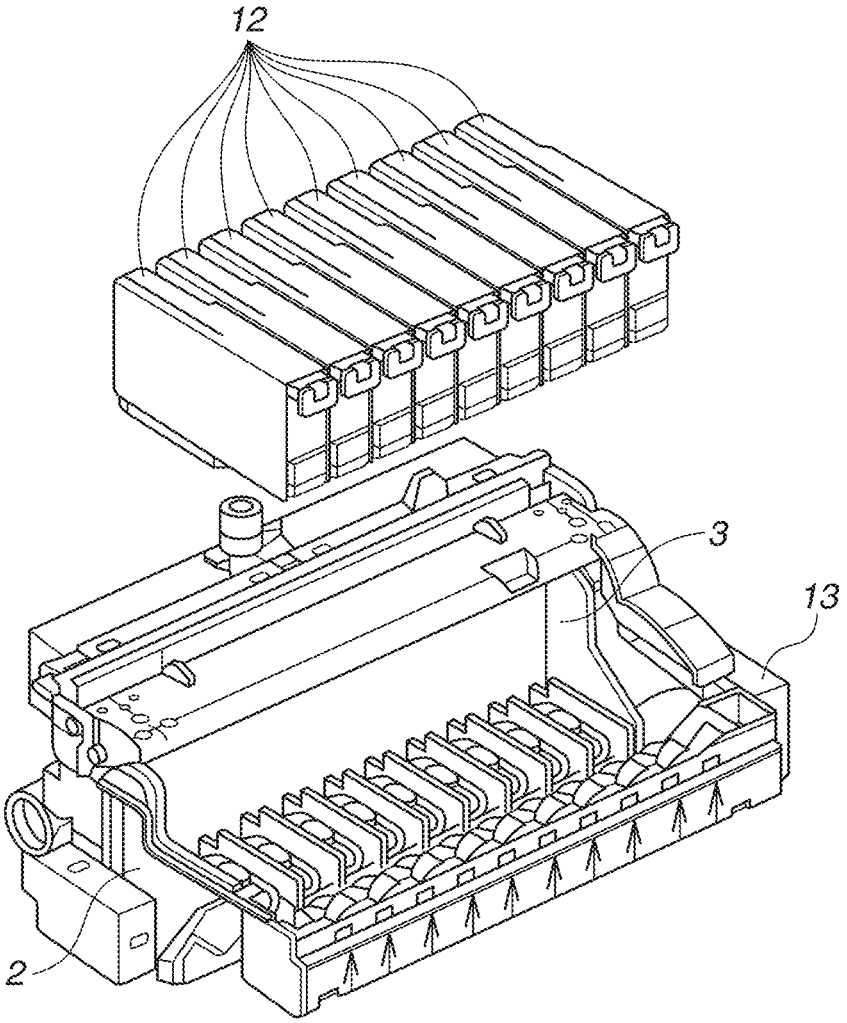
FIG. 3 is a perspective view illustrating a configuration of the recording unit according to the first exemplary embodiment.

FIG. 3 is a diagram illustrating a configuration of the recording unit according to the present exemplary embodiment. The recording head 3 is detachably attached to the carriage 2. Furthermore, nine types of ink tanks (e.g., ink cartridges) 12 are detachably attached to the recording head 3. The recording apparatus 1 records an image using nine types of inks, and nine individual ink tanks 12 are attached to the recording head 3. In the present exemplary embodiment, the nine types of inks are pigment inks. The nine types include a cyan ink, a magenta ink, a yellow ink, a black ink, a red ink, a light cyan ink, a light magenta ink, a gray ink, and a clear ink. In the present exemplary embodiment, among the nine types of pigment inks used in this example, a dark color ink such as the magenta ink, the cyan ink, the yellow ink, the black ink, and the red ink has a high concentration of solid component. Such an ink is easily solidified, is poorly absorbed into the ink absorber 21, and is easily accumulated. Thus, such an ink is regarded as an accumulation ink. On the other hand, the light cyan ink, the light magenta ink, and the clear ink have a low concentration of solid component. Such an ink is easily absorbed into the ink absorber 21, and can promote an accumulated pigment ink to be absorbed. Thus, such an ink is regarded as an accumulation reduction ink.

In the present exemplary embodiment, while an accumulation ink is a pigment ink, a dye ink is also regarded as an accumulation ink, in a case, for example, where the dye ink accumulates on an absorber in a recording apparatus that uses the dye ink. The number of types of inks is not limited to nine. Each type of the inks may be classified into the accumulation ink or the accumulation reduction ink in a different way. For example, each ink may be classified into an accumulation ink or an accumulation reduction ink depending on an amount of solvent or moisturizing agent contained in each ink. This is because a large content of solvent in an accumulation reduction ink can suppress a viscosity of the ink and make the ink easily-absorbed into the absorber. Therefore, a pigment ink that has a large content of solvent or moisturizing agent is easily absorbed into the ink absorber and thus can be classified as the accumulation reduction ink. In addition, while some pigments easily accumulate, the other pigments are less likely to accumulate depending on the property of pigment. If an ink has a property of being less likely to accumulate even if the ink has a large content of pigment, the ink may be classified as the accumulation reduction ink.

On the discharge port surface 20 of the recording head 3, an array of discharge ports for discharging ink of the respective colors are arranged in the Y direction. A recording element is disposed immediately above each discharge port (e.g., +Z direction). The recording element is a thermoelectric conversion element. By applying voltage, thermal energy is generated and the ink is discharged from a discharge port by the thermal energy. Instead of the thermoelectric conversion element, a piezoelectric element, an electrostatic element, or a microelectromechanical system (MEMS) element can also be used as the recording element.

The carriage 2 is provided with a detection sensor 3 as a detection unit including a light emitting unit 201 that emits light and a light receiving unit 203 that receives light that has been emitted by the light emitting unit 201 and specularly reflected. The detection sensor 13 emits light from the light emitting unit 201 at a predetermined angle onto an inspection target at a predetermined position in the moving direction of the carriage 2. The light receiving unit 203 receives specularly-reflected light from the inspection target. The details of the detection sensor 13 will be described below.

(Platen Portion)

Figure 4:
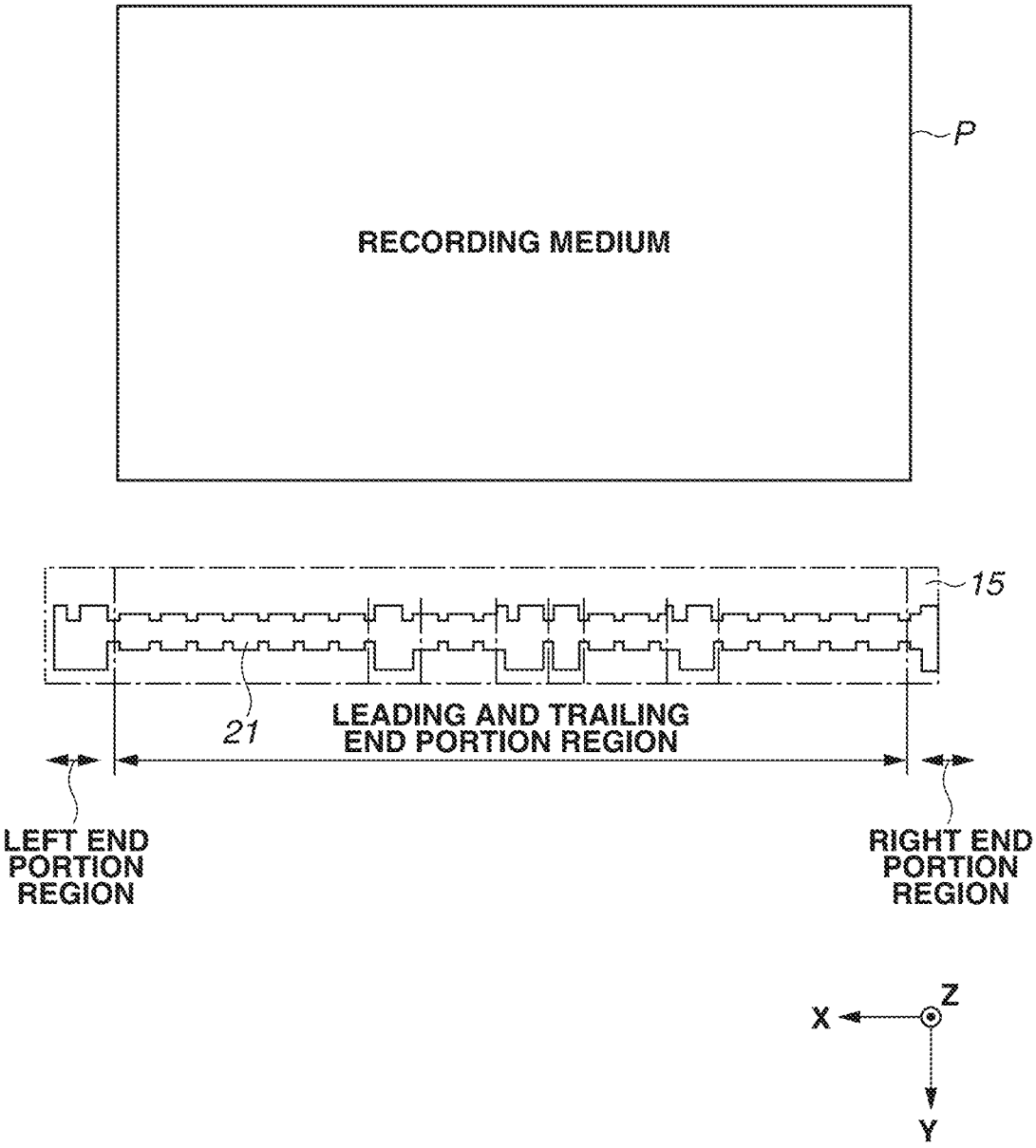
FIG. 4 is a diagram illustrating a relationship between a recording medium and an absorber according to the first exemplary embodiment.

FIG. 4 is a diagram illustrating the recording medium P and the platen 15 viewed from above. The diagram illustrates a relationship between the recording medium P and the ink absorber 21 disposed on the platen 15, in performing marginless recording.

The platen 15 extends in a main scanning direction over a pathway in which the recording head 3 scans so that the platen 15 supports the recording medium that passes above the platen 15, The platen 15 includes the ink absorber 21 for absorbing ink discharged to the outside of the recording medium in a protruding manner in executing the marginless recording. The ink absorber 21 also absorbs the ink discharged by preliminary discharge that does not affect recording to maintain or improve a discharge state of the ink. In the present exemplary embodiment, an opening is provided in the ink absorber 21 for easily absorbing the ink, A surface of the ink absorber 21 is uneven. The ink absorbed into the ink absorber 21 is later collected into a waste ink storage (not illustrated) provided in a lower part of the recording apparatus 1. The waste ink storage also collects the ink discharged to the cap 30. When the marginless recording is performed in the present exemplary embodiment, the ink is applied from the recording head 3 up to a region protruding outward by about 3 mm from the recording medium. In the case of performing the marginless recording on the recording medium P illustrated in FIG. 4, the ink is discharged to portions corresponding to a leading and trailing end portion recording region, a left end portion region, and a right end portion region of the ink absorber, when an image is recorded in a leading end portion and a trailing end portion of the recording medium P. When an image in other portions of the recording medium P is recorded, the ink is discharged to portions corresponding to the left end portion region and the right end portion region of the ink absorber 21.

(Block Diagram)

Figure 5:
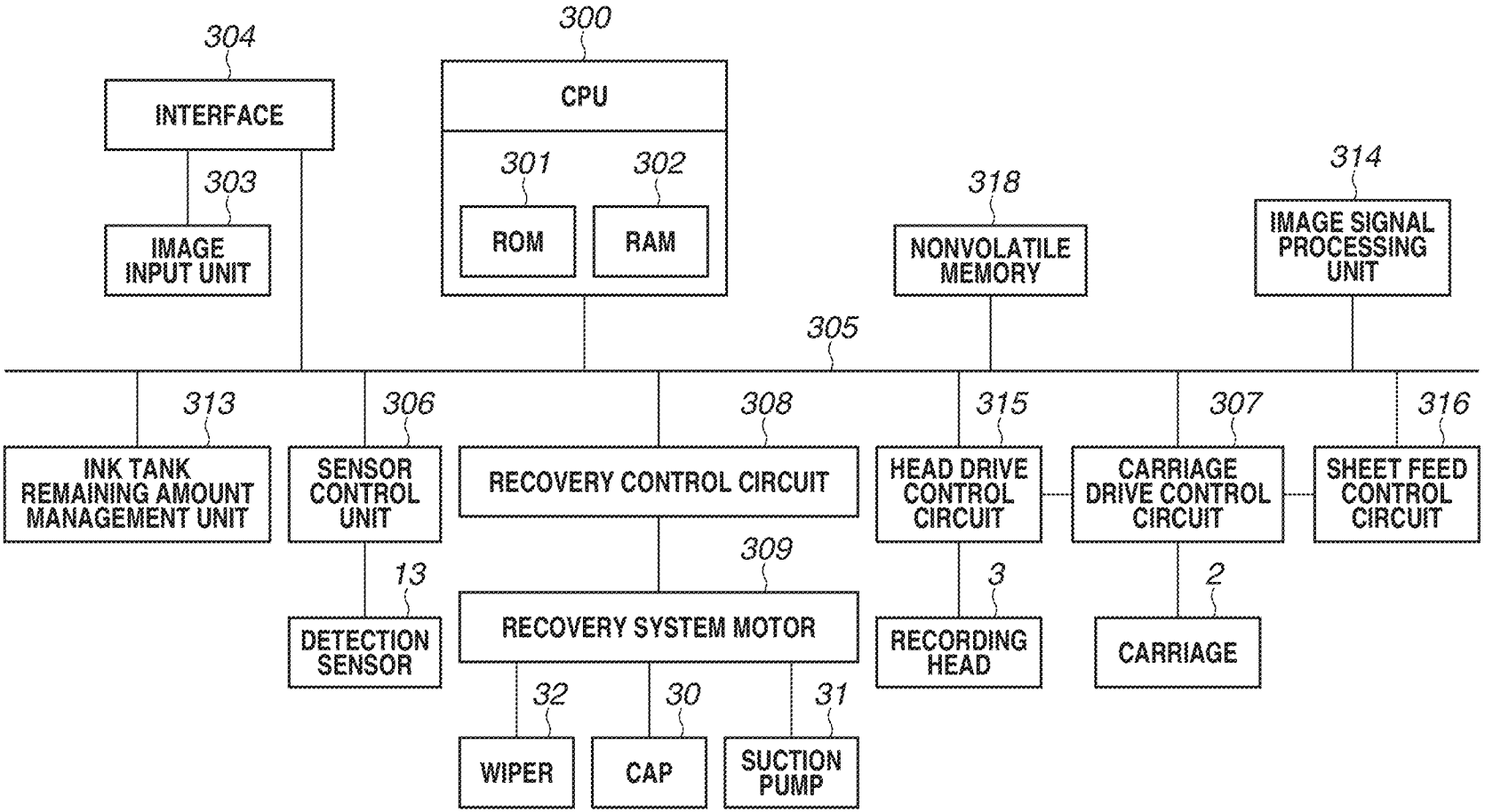
FIG. 5 is a block diagram illustrating an overall control configuration of the recording apparatus according to the first exemplary embodiment.

FIG. 5 is a block diagram illustrating an overall control configuration of the recording apparatus according to the present exemplary embodiment. A central processing unit (CPU) 300 includes a read-only memory (ROM) 301 and a random access memory (RAM) 302. Based on programs stored in the ROM 301, the CPU 300 controls data processing, recording head driving, and carriage driving via the following components, and performs a maintenance operation including a recording operation and the preliminary discharge. The RAM 302 is used as a work area for data processing performed by the CPU 300, and temporarily holds a plurality of pieces of scan recording data, and parameters related to a recovery processing operation and a supply operation of the inkjet recording apparatus. An interface 304 can connect a host apparatus and the recording apparatus 1. The CPU 300 performs communication processing with the host apparatus via the interface 304.

A nonvolatile memory 318 stores an amount of ink stored in the waste ink storage, an amount of ink discharged to the ink absorber 21, a discharge time of the ink, and information of the ink. The nonvolatile memory 318 can hold the information even if the power of the inkjet recording apparatus is turned OFF. The ink discharged to the ink absorber 21 is measured by counting ink discharged to the outside of the recording medium, based on image data. An amount of ink stored in the waste ink storage is calculated by counting ink discharged to the ink absorber 21 and the cap 30, and multiplying the counted ink amount by a vaporization coefficient. An ink tank remaining amount management unit 313 manages information regarding a remaining amount in each of the ink tanks 12, based on the ink information stored in the nonvolatile memory 318. If the remaining amount in the ink tank 12 that is stored in the ink tank remaining amount management unit 313 reaches a predetermined amount or less, the CPU 300 causes a yarning for prompting exchange to be displayed on a display connected to the host apparatus.

A recovery control circuit 308 performs drive control of a recovery system motor 309, and controls recovery operations such as upward and downward operations of the cap 30, an operation of the wiper 32, and an operation of the suction pump 31.

An image input unit 303 temporarily holds image data input from the host apparatus via the interface 304. The image data input to the image input unit 303 is subjected to predetermined image processing executed in an image signal processing unit 314, and then recording data available for a recording operation is generated. The recording head 3 and the carriage 2 are controlled based on the recording data.

A head drive control circuit 315 drives the recording element of the recording head 3. By driving the recording element, the recording head 3 is caused to perform ink discharge and the preliminary discharge. A carriage drive control circuit 307 controls a reciprocating movement in the main scanning direction (e.g., the X direction) of the carriage 2. The carriage drive control circuit 307 controls the movement of the carriage 2 to move the recording head 3 above a maintenance unit for performing a suction operation. A sheet feed control circuit 316 controls the driving of the conveyance motor based on a program stored in the RAM 302.

A sensor control unit 306 controls the detection sensor 13. The detection sensor 13 emits light from the light emitting unit 201 onto the ink absorber 21, and outputs a reflected light amount of specularly-reflected light received by the light receiving unit 203 in a voltage value.

(Details of Detection Sensor)

Figure 6:
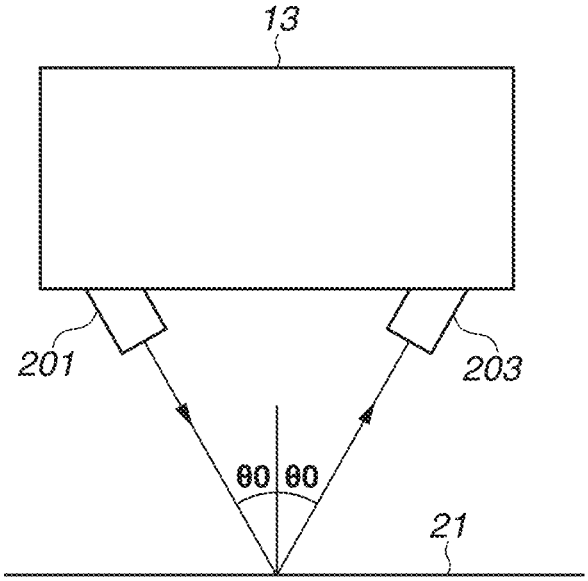
FIG. 6 is a diagram illustrating an operation of a detection sensor according toe first exemplary embodiment.

FIG. 6 is a diagram illustrating the detection sensor 13 provided on the carriage 2, and the detection of specularly-reflected light from the ink absorber 21. As described above, the detection sensor 13 includes the light emitting unit 201 and the light receiving unit 203. The light emitting unit 201 includes a light-emitting diode (LED), which is a light source of sensor light and emits red light. The light emitting unit 201 emits sensor light at a predetermined angle $\theta_0$ onto the ink absorber 21. The light receiving unit 203 is a photo transistor and receives light reflected by the ink absorber 21. At this time, for receiving specularly-reflected light, the light receiving unit 203 is disposed at a position at which an incident angle and a reflection angle both become equal at θ0. As a received light amount at the light receiving unit 203 becomes larger, higher voltage is output.

(Accumulation of Ink)

When ink accumulates on the ink absorber 21, first of all, moisture in the ink evaporates in the ink absorber 21 and the viscosity of the ink increases. Accordingly, the ink stays inside the ink absorber 21 is solidified without reaching the waste ink storage. At this time, solid components in the ink are solidified, and the solid components are mainly pigments. In addition, moisture that has not been evaporated is also contained.

The ink accumulated on the solidified ink is also solidified in the ink absorber 21 by moisture evaporating. Accordingly, the ink accumulates up to the surface of the ink absorber 21, and fills the uneven surface of the absorber by being solidified on the surface, and thus the surface becomes smoother than the surface of the absorber 21 with no ink adhesion. After that, when the ink absorber 21 becomes unable to absorb the ink, the ink further accumulates. In the present exemplary embodiment, a state which the ink absorber 21 has a smoother surface by the ink accumulating up to the surface of the ink absorber 21 and being solidified is regarded as an ink accumulated state.

Figure 7A:
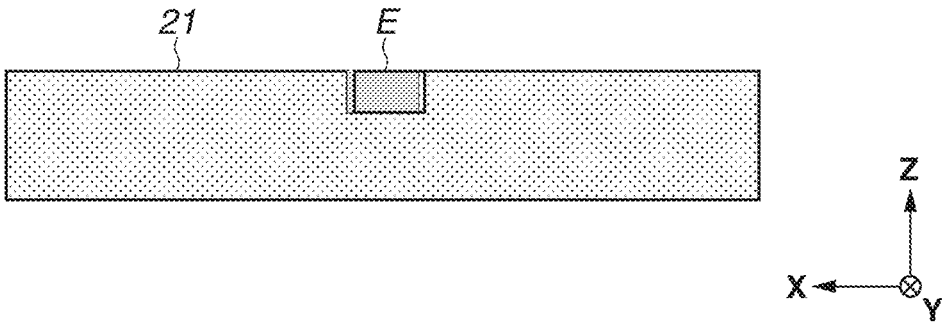
FIGS. 7A to 7C are diagrams and a graph illustrating accumulation detection according to the first exemplary embodiment.

FIG. 7A is a schematic diagram illustrating an ink accumulated state in a range in which the ink is discharged onto the ink absorber 21. In the marginless recording or the preliminary discharge, the ink is discharged in a range extending in the Y direction, and an ink accumulation range extends also in the Y direction, because discharge ports of the recording head 3 are arranged in the Y direction. Nevertheless, the carriage 2 moves only in the X direction, and a processing position is changed in the X direction. Thus, only positions in the X direction will be described.

Figure 7B:
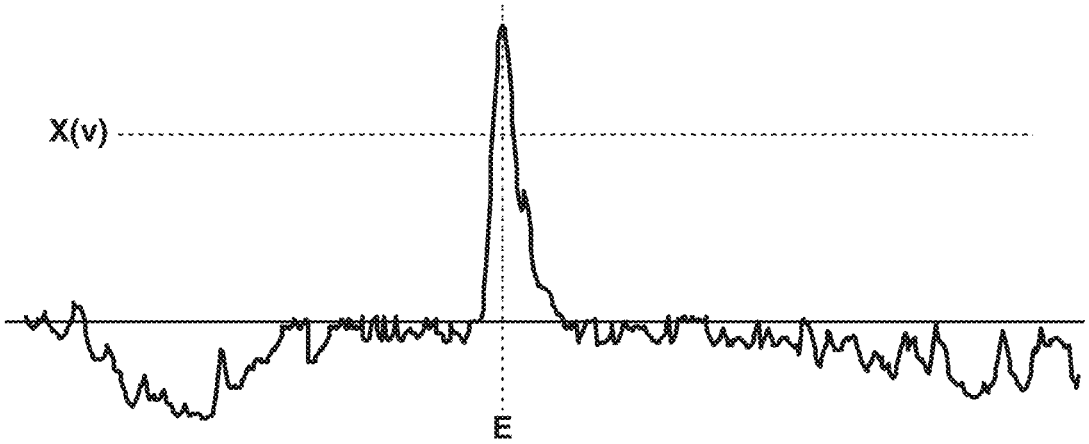

FIG. 7A illustrates a state in which an ink accumulates on a part of the ink absorber 21. A portion in which the ink accumulates is displayed in a color darker than the color of the peripheral portion. In a case where the detection sensor 13 detects a position E, an accumulation reduction ink can be discharged based on the detection, and ink accumulation can be reduced in a certain degree of range. In the example illustrated in FIG. 7A, a portion with an accumulated ink falls within a range in which accumulation can be reduced. The position E is a center position in the range. FIG. 7B illustrates a graph indicating an output result of the detection sensor 13 at each position corresponding to FIG. 7A. As illustrated in FIG. 7A, if an ink accumulates, an unevenness of the ink absorber 21 is filled with a solidified ink. The surface thereby becomes smoother than the surfaces of other portions of the ink absorber 21. The detection sensor 13 emits sensor light to the position E from the light emitting unit 201 to detect ink accumulation illustrated in FIG. 7A. Since the ink accumulates at the position E, the intensity of specularly-reflected light becomes higher than the surface of the ink absorber 21 on which no ink accumulates when the sensor light is emitted. The same applies to a case where the accumulation further advances. In the graph illustrated in FIG. 7B, an output value at the position E is greater than or equal to a threshold X(v). By determining that an ink accumulates in a range in which ink accumulation can be reduced, at the position at which an output value greater than or equal to the threshold X(v) is obtained, it is possible to detect an ink accumulated state on the ink absorber 21.

Figure 7C:
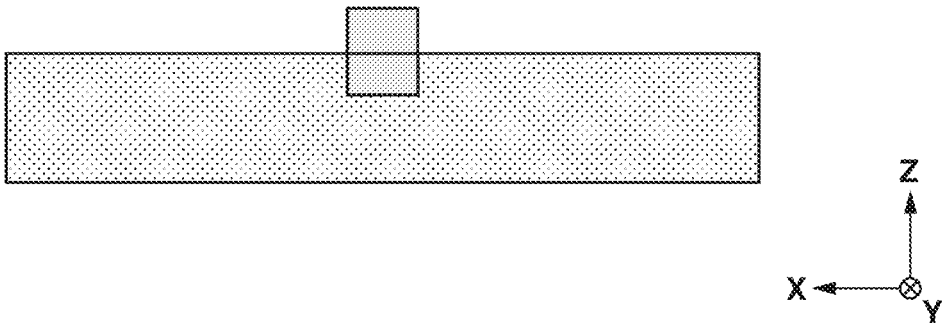

FIG. 7C is a diagram illustrating a state in which the ink accumulation in FIG. 7A further advances. If the ink accumulates up to the height greater than or equal to a predetermined value, the rear surface of paper becomes soiled.

In the present exemplary embodiment, it is determined that an ink has accumulated, in a case where an output value becomes greater than or equal to the threshold X(v). However, another method may be used. For example, an output value may be compared with a value detected in a state in which the ink absorber 21 is not soiled. It may be determined that an ink accumulates, when a difference between two output values becomes greater than or equal to a predetermined value. The detected value detected in a state in which the ink absorber 21 is not soiled may be preset. As another method, the detected value may be detected when the use of the recording apparatus is started.

In the present exemplary embodiment, an example of detecting accumulation using specularly-reflected light has been described. Alternatively, the presence or absence of accumulation may be detected by using diffusely-reflected light. Reflection intensity caused by the accumulation height may also be used for the detection.

Figure 8A:
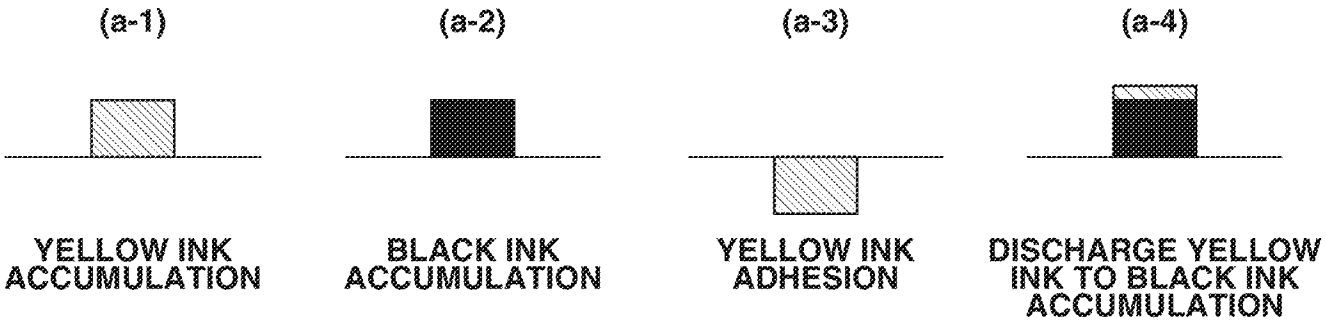
FIGS. 8A and 8B are diagrams illustrating accumulation detection according to the first exemplary embodiment.
Figure 8B:
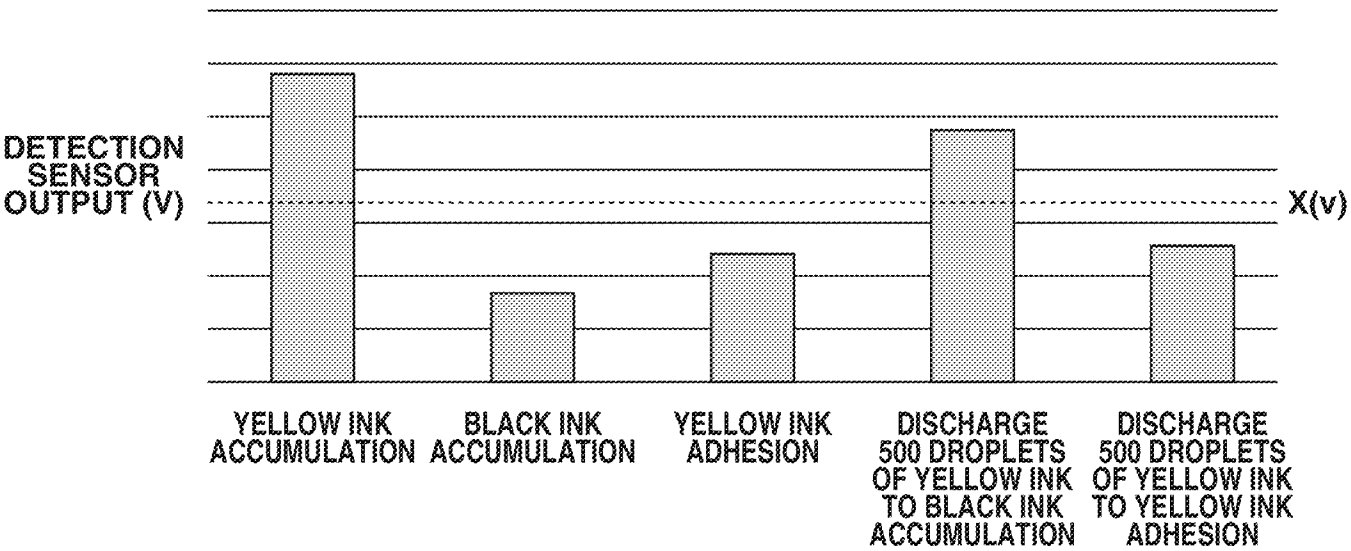

FIG. 8A is a schematic diagram illustrating states of inks accumulated on the ink absorber 21. FIG. 8B illustrates a graph indicating output results obtained when targets in the states illustrated in FIG. 8A are measured by the detection sensor 13. Regarding sensor light of the light emitting unit 201, a black ink has low specular reflection intensity because the black ink absorbs the sensor light, and a yellow ink has high specular reflection intensity because the yellow ink poorly absorbs the sensor light. FIGS. 8A and 8B illustrate a case where a yellow ink accumulates, a case where a black ink accumulates, a case where a yellow ink only adheres to the surface of the ink absorber 21 (hereinafter, referred to as yellow ink adhesion), and a case where a yellow ink is discharged onto the black ink accumulation. As illustrated in FIG. 8B, the black ink accumulation has a lower output value than that of yellow ink adhesion. If an ink accumulates, a portion with the accumulated ink becomes smooth and specular reflection intensity increases. However, an output value becomes lower because a black ink absorbs sensor light. If the threshold X(v) is set in such a manner that the black ink accumulation can be detected, the yellow ink adhesion is also determined as accumulation.

In the present exemplary embodiment, 500 droplets of yellow ink having a color that poorly absorbs light of the light emitting unit 201 are discharged to the position E as a position to be detected, before a detection operation is performed. A state in which 500 droplets of yellow ink are discharged onto the black ink accumulation is illustrated in (a-4) of FIG. 8A, The yellow ink is applied onto the surface of the black ink accumulation, and a color of the surface of accumulation becomes yellow. If the detection sensor 13 detects this state, an output value becomes higher than that obtained in a case where 500 droplets of yellow ink are discharged onto the yellow ink adhesion. By setting the threshold X(v) to a value between an output value obtained when the yellow ink is discharged onto the black ink accumulation and an output value obtained when the yellow ink is discharged onto the yellow ink adhesion, it is possible to distinguish between an accumulated state and an adhesion state. 500 droplets of yellow ink to be discharged to the position E in the present exemplary embodiment corresponds to an amount of ink that does not accumulate when being discharged onto the ink absorber 21, and that can make the color of the surface of an accumulated substance yellow. In the position E, if the color of the surface at a position on which light emitted from the light emitting unit 201 of the detection sensor 13 is incident is yellow, the same effect as that obtained in a case where a yellow ink is applied to the entire processing range including the position E can be obtained.

(Accumulation Detection Processing)

Figure 9:
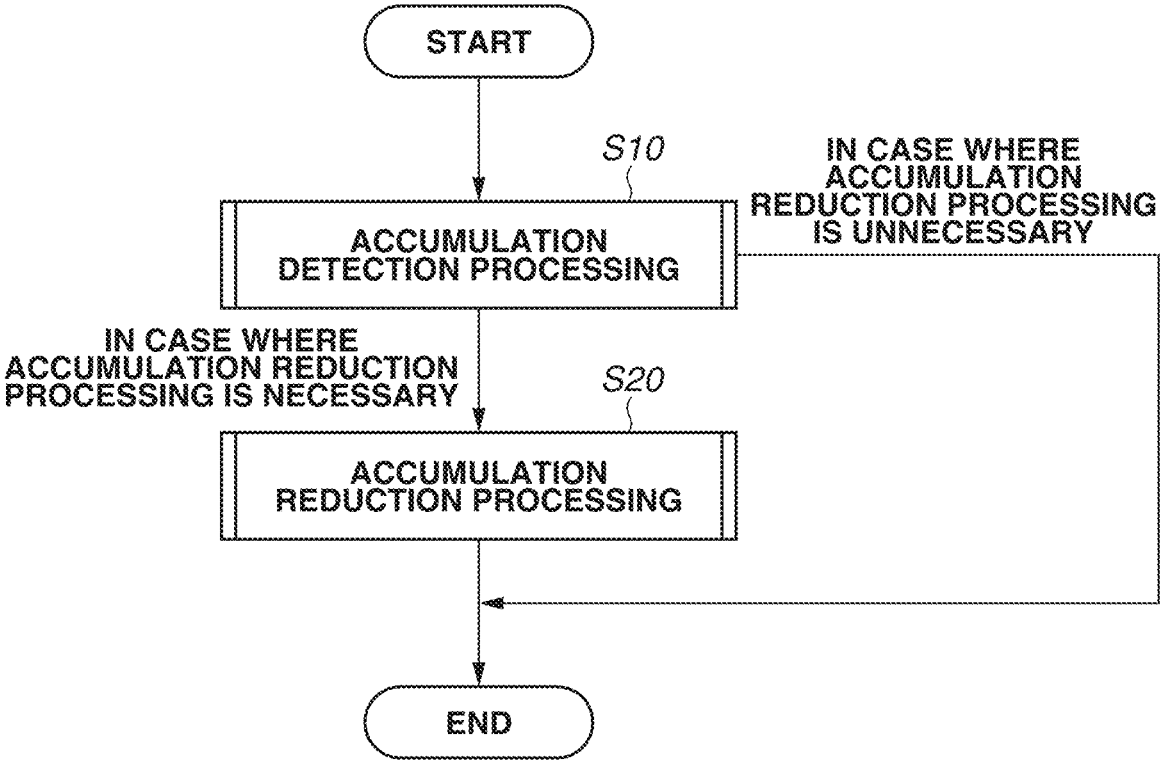
FIG. 9 is a flowchart illustrating a flow of accumulation detection processing and accumulation reduction processing according to the first exemplary embodiment.

FIG. 9 is a flowchart illustrating a flow of accumulation detection processing to detect an ink accumulation state at the position E on the ink absorber 21, and accumulation reduction processing to reduce ink accumulation at the position E. The accumulation detection processing in step S10 is an operation performed after a recording operation ends. In a case where it is determined in the accumulation detection processing that accumulation reduction processing is necessary, the accumulation reduction processing in step S20 is performed. In a case where it is determined that the accumulation reduction processing is unnecessary, the processing ends without performing the accumulation reduction processing.

A position at which an ink is to be discharged onto the ink absorber 21 by the marginless recording or the preliminary discharge is predefined. The accumulation detection processing is performed with respect to the defined position. For example, in a case of performing the marginless recording on a recording medium having an A4 size, the preliminary discharge is performed after the marginless recording ends. And then, the accumulation detection processing is performed for both a position at which an ink is discharged onto the ink absorber 21 by A4-size marginless recording (near both ends of a pass region of an A4-size sheet), and an outer position at which the ink is discharged onto the ink absorber 21 by the preliminary discharge. The accumulation detection processing is to be executed at a plurality of points. However, the accumulation detection processing and the accumulation reduction processing cannot be concurrently performed at a plurality of points. The processing is therefore performed by setting an accumulation detection position which is a range that can be targeted in one accumulation reduction processing, as the position E, among a the plurality of positions. In a case where a range in which the accumulation detection processing is performed is larger than the range that can be targeted in one processing, a target position subsequently moves to a position at which another range can be processed. The accumulation detection processing and the accumulation reduction processing that have been described using FIG. 9 are performed using the position set after the movement as the position E. The range in which the accumulation detection processing is performed may be preset, or the range may be identified by the detection performed by the detection sensor 13.

Figure 10:
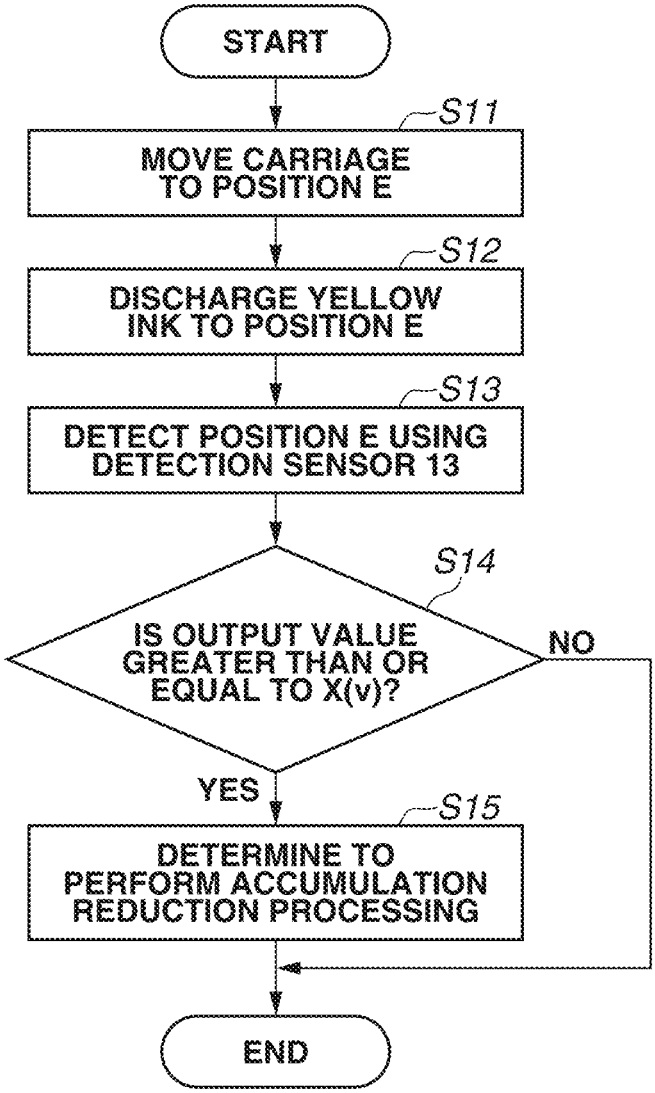
FIG. 10 is a flowchart illustrating accumulation detection processing according to the first exemplary embodiment.

FIG. 10 is a flowchart illustrating the accumulation detection processing to detect ink accumulation on the ink absorber 21 in step S10 of FIG. 9. The accumulation detection processing illustrated in FIG. 10 is processing to be performed in a case where the CPU 300 issues an execution instruction of the accumulation detection processing after the preliminary discharge following the recording ends. The accumulation detection processing is performed by the CPU 300 by controlling the sensor control unit 306, the head drive control circuit 315, and the carriage drive control circuit 307 based on a program stored in the ROM 301.

In step S11, the carriage drive control circuit 307 moves the carriage 2 to the position E at which an ink is discharged onto the ink absorber 21.

In step S12, 500 droplets of a yellow ink are discharged to the position E from the recording head 3. The yellow ink has a color that poorly absorbs red, which is a color of sensor light of the light emitting unit 201. By discharging the yellow ink to the position E, the color of the surface of an accumulated substance produced in a case where an ink is accumulated at the position E becomes yellow. By yellowing the surface of an accumulated substance having an output value of the detection sensor 13 lower than an output value obtained by yellow ink adhesion, the output value of the accumulated substance becomes higher than that obtained by the yellow ink adhesion. Thus, it is possible to correctly distinguish between an accumulated state and an adhesion state.

In step S13, the sensor control unit 306 controls the detection sensor 13 to perform a detection operation. More specifically, light is emitted from the light emitting unit 201 at a predetermined angle $\theta_0$ onto the ink absorber 21, and reflected light is received by the light receiving unit 203. In step S14, the sensor control unit 306 converts an amount of light received by the light receiving unit 203 acquired in step S13 into voltage, and outputs the voltage. The CPU 300 determines whether an output value of the sensor control unit 306 is greater than or equal to the threshold X(v). The threshold X(v) is stored in the ROM 301. As illustrated in FIG. 7B, in a case where the output value is greater than or equal to the threshold X(v) (YES in step S14), it is determined that the ink accumulates, and the processing proceeds to step S15. In a case where the output value is smaller than the threshold X(v) (NO in step S14), it is determined that the ink does not accumulate, and the processing ends.

In step S15, because the ink is accumulated, it is determined to perform the accumulation reduction processing, and the processing ends.

Figure 11A:
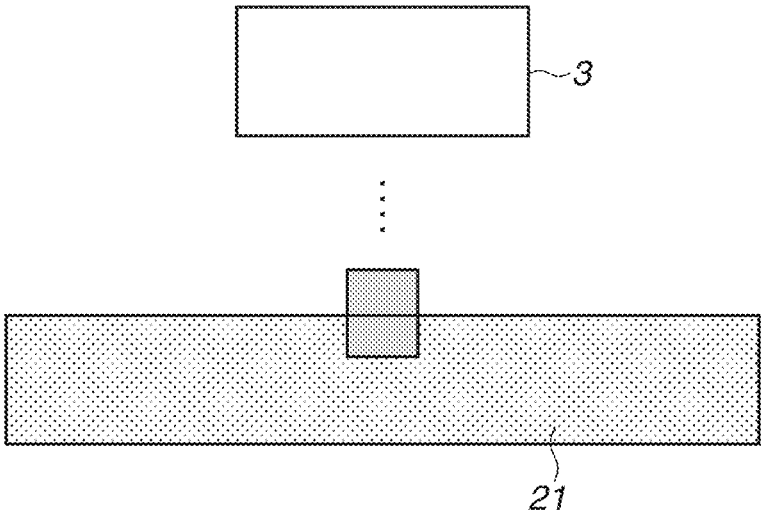
FIGS. 11A and 11B are diagrams illustrating accumulation reduction control according to the first exemplary embodiment.
Figure 11B:
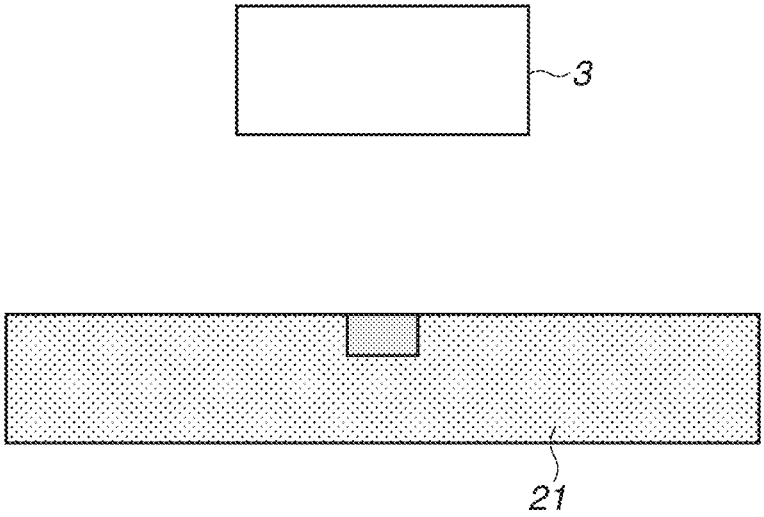

In a case where it is determined in step S15 to perform the accumulation reduction processing, the accumulation reduction processing in step S20 of FIG. 9 is performed after the accumulation detection processing ends. FIGS. 11A and 11B are diagrams illustrating the accumulation reduction processing. FIG. 11A illustrates a state in which an accumulation reduction ink is discharged from the recording head 3 to the position E at which accumulation is detected. In the present exemplary embodiment, a clear ink, as an accumulation reduction ink, is discharged by a predetermined amount. By discharging the accumulation reduction ink to the accumulation spot, a solidified accumulated substance is liquefied again and is absorbed into the ink absorber 21. By discharging the accumulation reduction ink to the position E, the accumulation reduction ink flows also into a surrounding region of the position E, so that an accumulated substance can be liquefied again and be absorbed into the ink absorber 21. By the processing, the accumulated substance liquefies to become an ink state. Thus, the liquefied ink flows downward into the ink absorber 21, and the accumulated state is eliminated as illustrated in FIG. 11B. An amount of the accumulation reduction ink to be discharged may be a predefined discharge amount. Alternatively, after a certain amount of accumulation reduction ink is discharged, a discharge operation may be repeated until an output value obtained by performing the accumulation detection at the position E falls below the threshold X(v). If the application of accumulation reduction ink ends, accumulation reduction control ends. In a case where an ink might accumulate at another point on the ink absorber 21, the processing is started from the accumulation detection processing using the point as the position E.

As another embodiment of the accumulation reduction processing, a notification may be made by displaying a message indicating that, for example, "please clean the absorber on the platen" on the display connected to the host apparatus, to prompt a user to clean the ink absorber 21. Issuing a warning indicating that the marginless recording is to be restricted, or displaying an error may also be made.

In the configuration of repeating a discharge operation until an output value obtained by performing accumulation detection at the position E falls below the threshold X(v), after a certain amount of ink is discharged in an accumulation reduction operation, an output value does not decrease in some cases even if the accumulation reduction operation is repeated. In this case, for example, a sensor may be faulty. In a case where the sensor is faulty, a reliable output value cannot be obtained. Thus, there is a possibility that an output value does not decrease even if the accumulation reduction ink is discharged. If the accumulated ink strongly adheres to the ink absorber 21 by being left for a long term, or the ink absorber 21 is soiled by another external factor, in some cases, it is considered that an output value does not recover even if the accumulation reduction ink is discharged by an amount normally considered to be necessary. In this case, even if the accumulation reduction ink is discharged, an output value does not fall below the threshold, and the accumulation reduction ink is wasted.

In view of the above-described case, restrictions may be imposed on the number of times the accumulation reduction ink is discharged after the accumulation detection processing. In a case where the number is restricted to, for example, three, the subsequent accumulation detection processing is not executed, if the accumulation detection processing and the accumulation reduction processing are repeated three times.

The accumulation detection processing and the accumulation reduction processing illustrated in FIG. 9 are performed in a state in which the carriage 2 remains at rest at the position E. Alternatively, the detection may be performed while the carriage 2 is scanning, and ink discharge may be performed after the carriage 2 stops at a point requiring accumulation reduction control. In a case where only the accumulation detection processing is initially performed a plurality of times for a wide region such as a leading and trailing end region illustrated in FIG. 4, and accumulation is detected over the wide region, an accumulation reduction ink may be discharged by the carriage 2 scanning a predetermined number of times though the accumulation reduction processing. In a case where a region in which accumulation is detected is sufficiently narrow, the carriage 2 may stop above the detected region and the accumulation reduction ink may be discharged. In a case where accumulation is detected at a plurality of separated regions, the accumulation reduction processing may be consecutively performed on the detected regions after the end of detection. The accumulation reduction ink may be discharged in a range extending in the X direction in which an ink accumulates while moving the carriage 2. At this time, the carriage 2 may be moved around the detected position E.

In the present exemplary embodiment, the detection is executed after the recording operation ends. Alternatively, expecting a situation in which ink accumulation is likely to occur, the detection may be executed at a predetermined timing. The accumulation detection processing may be performed, for example, only after the marginless recording is performed.

Figure 12:
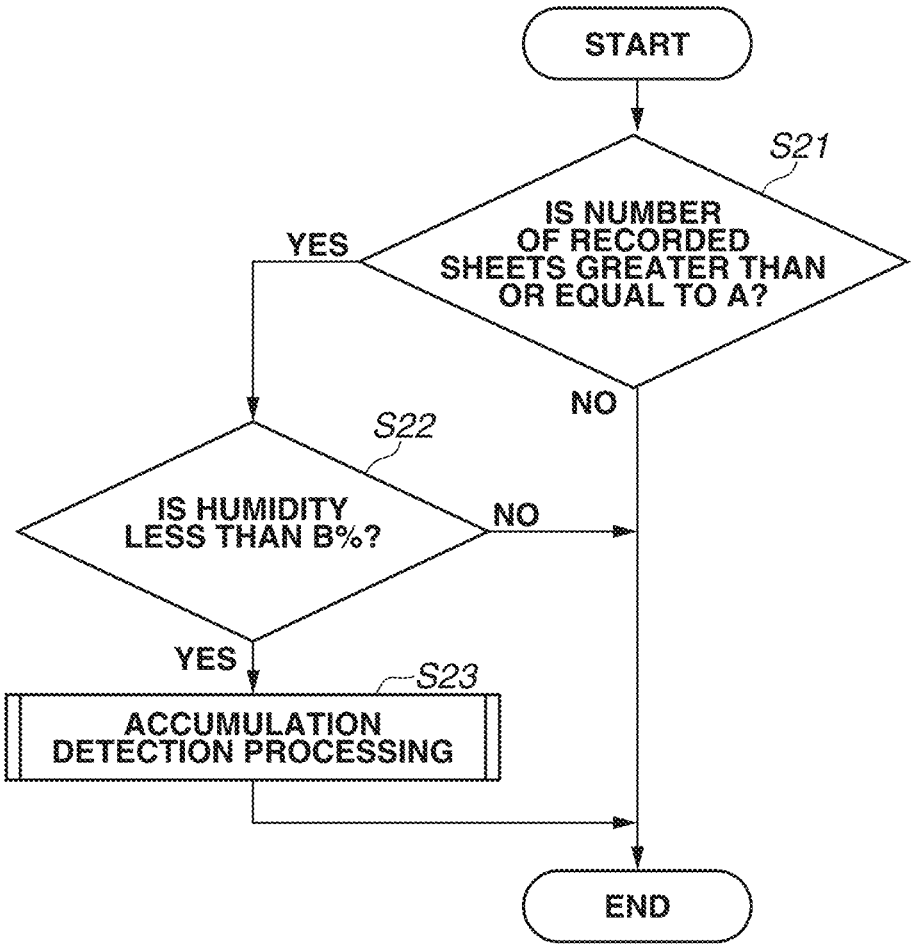
FIG. 12 is a flowchart illustrating an example of an execution timing of accumulation detection processing according to the first exemplary embodiment.

FIG. 12 is a flowchart illustrating an example of an execution timing of the accumulation detection processing. In this example, the accumulation detection processing is performed in a case where the number of recorded sheets recorded after the previous accumulation detection processing has been performed is large and humidity is low. The recording apparatus 1 includes a counter (not illustrated) that counts and stores the number of recorded sheets, and a humidity sensor (not illustrated) that detects the humidity.

In step S21, it is determined whether the number of recorded sheets recorded after the previous accumulation detection processing has been performed is greater than or equal to a predetermined number A. In a case where the number of recorded sheets is less than A (NO in step S21), the processing ends without performing the accumulation detection processing. In a case where the number of recorded sheets is greater than or equal to A (YES in step S21), the processing proceeds to step S22, in which it is determined whether the humidity is less than B %. In a case where the humidity is greater than or equal to B % (NO in step S22), the processing ends without performing the accumulation detection processing. In a case where the humidity is less than B % (YES in step S22), the accumulation detection processing is performed, and the processing illustrated in FIG. 12 ends. In a case where it is determined in the accumulation detection processing to perform the accumulation reduction processing, the accumulation reduction processing is performed after the processing illustrated in FIG. 12 ends.

A time elapsed from when the previous accumulation reduction processing has been performed may be included in conditions for starting the accumulation detection processing, because moisture of the ink discharged to the absorber evaporates and the ink becomes an easily-accumulating state over time. For example, a timer for measuring a time elapsed from when the accumulation reduction ink is discharged the last time may be provided. The accumulation detection processing may be performed in a case where the lapse time measured by the timer when it is determined whether to perform the accumulation detection processing exceeds 100 hours. Specifically, the following processing can be performed. In a case where humidity is less than B % in step S22 under the condition illustrated in FIG. 12 (YES in step S22), it is determined whether the time elapsed from the previous accumulation reduction processing exceeds 100 hours, before the accumulation detection processing is performed in step S23. In a case where the lapse time exceeds 100 hours, the accumulation detection processing is performed in step S23.

Since the accumulation detection processing takes time, the accumulation detection processing may be executed before a sleep operation or before a cap close operation of moving the recording head 3 to a position at which the discharge port surface 20 of the recording head 3 is covered by the cap 30, after the end of recording. In this manner, it is possible to further enhance convenience of the user by performing the accumulation detection processing when the user is unlikely to issue a recording instruction.

In a case of performing the accumulation detection processing for the first time, counting is started in a state in which the ink absorber 21 is new. Even if accumulation suppression processing is performed in the first accumulation detection processing, an ink is not completely removed from the ink absorber 21. Thus, when the accumulation detection processing is performed for the second time or later, the ink accumulates more easily on the ink absorber 21 than the time when the first accumulation detection processing has been performed. Thus, a condition of performing the detection for the second time or later may be varied from the condition for performing the first accumulation detection processing. For example, in the configuration of setting humidity, a lapse time, and the number of durable sheets as conditions for starting the accumulation detection processing. The first accumulation detection processing may be performed in a case where humidity is less than or equal to 10% in step S22 of FIG. 12, while the second and subsequent accumulation detection processing may be performed in a case where humidity is less than or equal to 20%. The first accumulation detection processing may be performed after recording has been performed on 500 sheets as thresholds of the number of durable sheets, while the second and subsequent accumulation detection processing may be performed every time recording has been performed on 100 sheets. The first accumulation detection processing may be performed in a case where the lapse time exceeds 500 hours, while the second and subsequent accumulation detection processing may be performed in a case where the lapse time exceeds 100 hours. Alternatively, conditions obtained by combining the above-described conditions may be set.

The detection sensor 13 is installed on one side in the X direction of the recording head 3 illustrated in FIG. 3. In some cases of the configuration of the recording apparatus, the detection sensor 13 cannot detect a position on one side on the ink absorber 21, depending on a scannable range of the recording head 3 and the width of a recording medium. In this case, it may be determined whether to execute the accumulation reduction processing on an undetectable position based on a detection result obtained on a detectable side. An amount of accumulation reduction ink to be discharged in the accumulation reduction processing may also be determined.

For example, the detection sensor 13 in FIG. 3 is provided on the right side in FIG. 3, and on the −X direction side (hereinafter, referred to as a HOME side) in FIG. 1. In a case where a scannable range of the recording head 3 is short, if a width in the X direction of a recording medium on which recording is to be performed is large, the detection sensor 13 cannot move to a position on the +X direction side (hereinafter, referred to as an AWAY side) at which ink accumulation at a marginless protruding position on the ink absorber 21 can be detected. Thus, whether to execute the accumulation reduction processing on a protruding position on the AWAY side is determined based on a detection result of the accumulation detection processing obtained on the HOME side. Alternatively, whether to execute accumulation suppression control may be determined based on a result obtained by comparison made between discharge amounts of inks discharged onto marginless protruding positions on the detectable side and the undetectable side, in addition to the detection result. More specifically, the execution control of the accumulation reduction processing may be performed in the following manner. For example, in a case where it is determined in the accumulation detection processing on the HOME side that the accumulation reduction processing is necessary, discharge amounts on the HOME side and the AWAY side are compared. As a result of the comparison, the accumulation reduction processing is not executed on the AWAY side if the discharge amount on the HOME side is larger. The accumulation reduction processing is executed on the AWAY side if the discharge amount on the HOME side is smaller.

(Shape and Color of Absorber)

In a case where light emission and light reception are in a relationship of specular reflection as illustrated in FIG. 6, and ink accumulation is detected using a sensor that determines the presence or absence of accumulation based on a difference in smoothness of the target, the smoothness (surface roughness) needs to vary between an accumulated state and a not-accumulated state. For example, in a case where there is small unevenness on the surface of the ink absorber and the surface is smooth, a small difference in surface roughness is obtained from the comparison between the accumulated state and the not-accumulated state. It therefore becomes difficult to determine the presence or absence of accumulation based on a reflection amount of specularly-reflected light. In the case of detecting ink accumulation based on a reflection amount of specularly-reflected unevenness on the surface of the ink absorber 21 is desirably large.

For example, in a case where the color of the ink absorber 21 is yellow and an ink to be discharged before the detection operation is magenta, detected values of the ink absorber 21 and ink accumulation might be close, because yellow absorbs red light more poorly than magenta. Thus, the detection becomes easier if the color of the ink absorber 21 is a color that absorbs light of a sensor more easily than an ink to be discharged before the detection operation.

(Colors of Sensor Light and Ink)

In the present exemplary embodiment, an LED emitting red sensor light is used, and a yellow ink is discharged before the detection operation. If sensor light with another color and a colored ink that poorly absorbs the sensor light are used, the present exemplary embodiment can be applied. The color that poorly absorbs the sensor light is a color having a hue closer to a hue of the color of the sensor light than to an intermediate hue between the color of the sensor light and a complementary color of the color of the sensor light.

In a case where the color of sensor light is red, the ink color may be a color having a hue from purple to yellow including red as a hue closer to the color of sensor light. Among the nine types of inks in the present exemplary embodiment, the yellow ink, the red ink, the magenta ink, and the light magenta ink can be applied.

For example, in a case where the color of sensor light is blue, the ink color may be a color having a hue from purple to green through blue as a hue closer to the color of sensor light. Among the inks in the present exemplary embodiment, the cyan ink and the light cyan ink can be applied.

By using the accumulation reduction ink such as the light magenta ink or the light cyan ink as the ink to be discharged before the detection operation, it is possible to liquefy the accumulated ink again, and to cause the liquefied ink to be absorbed into the ink absorber 21. It is therefore possible to reduce an amount of ink to be discharged in accumulation reduction control.

In the above-described exemplary embodiment, ink accumulation reduction of the ink absorber 21 has been described. However, the present disclosure may also be applied to accumulation reduction for an absorber provided in the cap capping the recording head 3.

In the first exemplary embodiment, the yellow ink is discharged to the position E to increase an output value of the black ink accumulation. In a second exemplary embodiment, accumulation is detected by decreasing an output value of adhesion of an ink in a color that poorly absorbs sensor light, such as yellow ink adhesion. The description of parts similar to those in the first exemplary embodiment, such as the configuration of a recording apparatus, will be omitted.

Figure 13A:
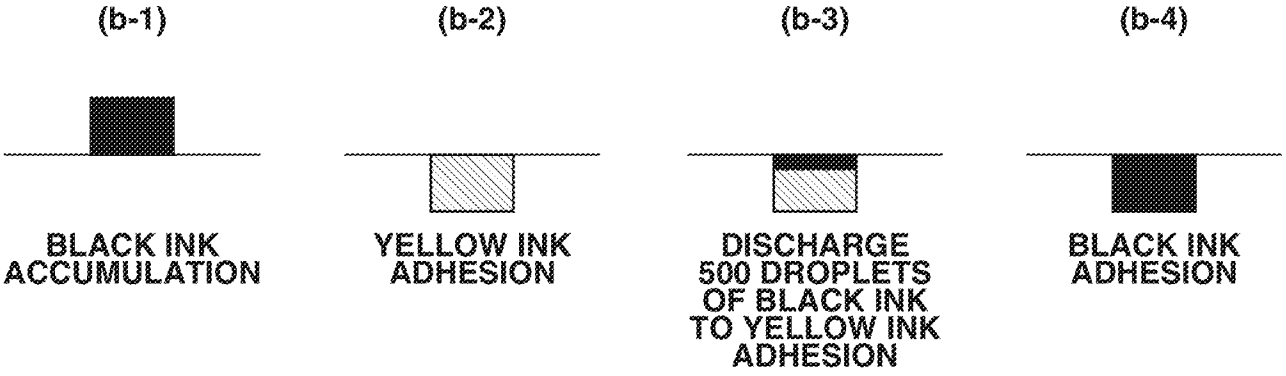
FIGS. 13A and 13B are diagrams illustrating accumulation detection according to a second exemplary embodiment.
Figure 13B:
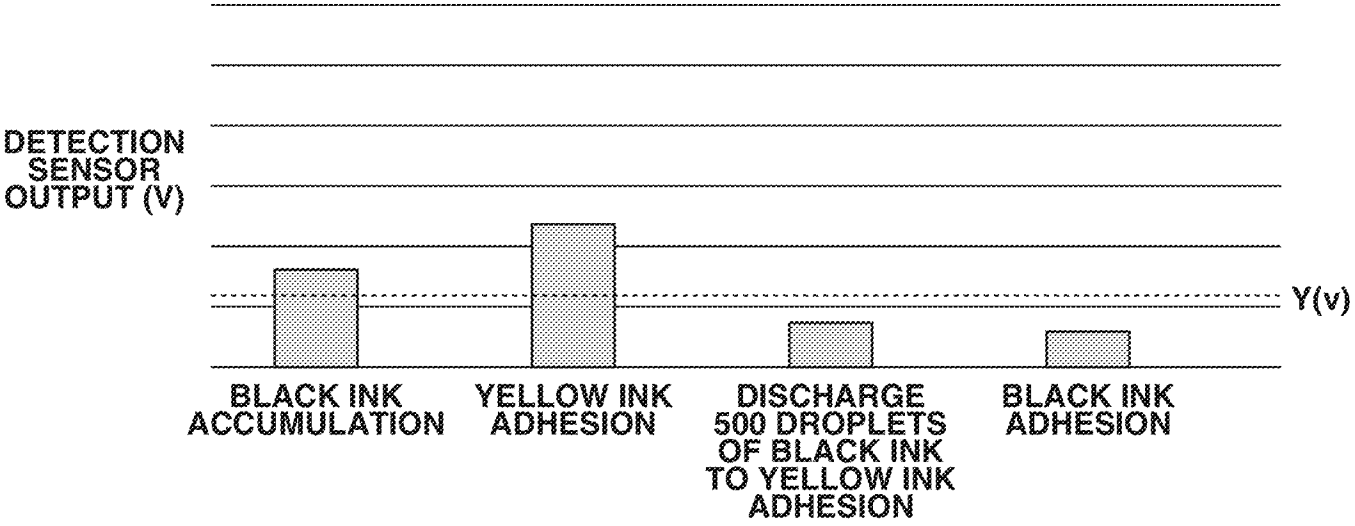

FIGS. 13A and 13B illustrate a case where the black ink accumulates, a case where the yellow ink adheres, a case where the black ink is discharged onto the yellow ink adhesion, and a case where the black ink adheres, and show output results detected by the detection sensor 13 in the respective cases. As illustrated in FIG. 13B, if a threshold is set in such a manner that black ink accumulation can be detected, yellow ink adhesion is erroneously detected as ink accumulation, because an output value of yellow ink adhesion is higher than an output value of black ink accumulation. In the present exemplary embodiment, 500 droplets of black ink are discharged to the position E to be detected. A state in which the black ink is discharged onto the yellow ink adhesion is illustrated in (b-3) of FIG. 13A. A reflection amount becomes smaller than that in a case where the surface is yellow as in the yellow ink adhesion illustrated in (b-2), because black absorbs light. It is easier to reflect light than a case where the black ink is discharged onto the yellow ink adhesion in (b-3), and an output value of black ink accumulation becomes larger, because the surface of black ink accumulation in (b-1) is smooth. It is possible to detect ink accumulation by setting a threshold Y(v) to a value between an output value of the black ink accumulation and an output value obtained in a case where a black ink is discharged onto the yellow ink adhesion.

Figure 14:
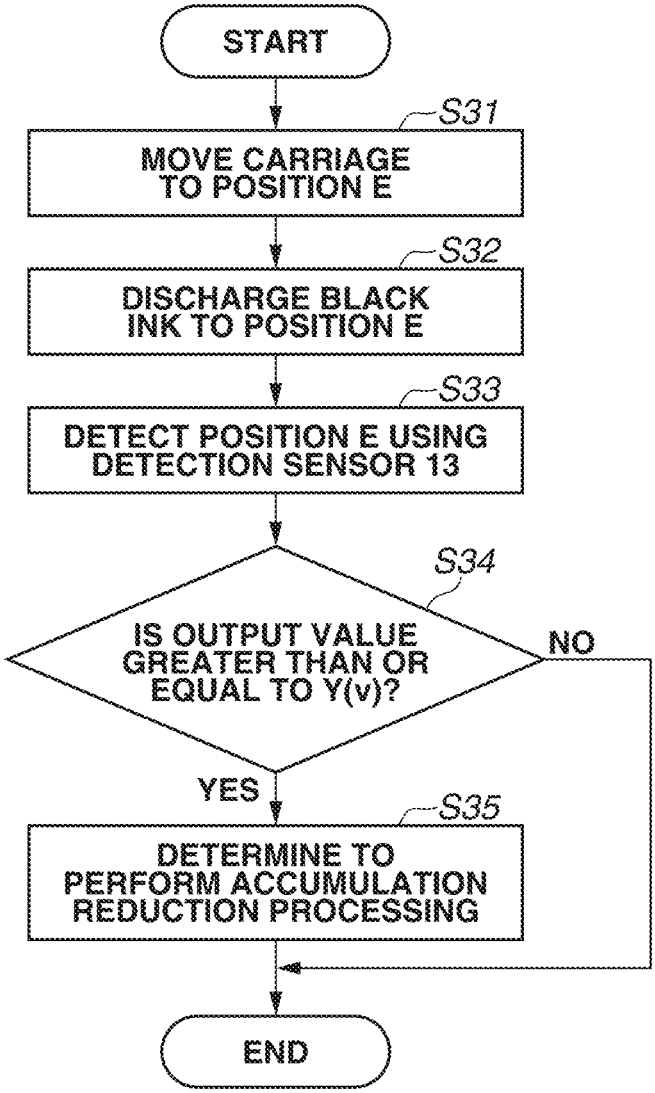
FIG. 14 is a flowchart illustrating accumulation detection processing according to the second exemplary embodiment.

FIG. 14 is a flowchart illustrating accumulation detection processing according to the present exemplary embodiment. In steps S31, and S33 to S35 in the present exemplary embodiment, operations similar to those performed in steps S11, and S13 to S15 in the first exemplary embodiment are performed.

In step S31, the carriage drive control circuit 307 moves the carriage 2 to the position E at which an ink is discharged onto the absorber 21. In step S32, the recording head 3 discharges 500 droplets of a black ink to the position E. The black ink has a color that easily absorbs red light from the light emitting unit 201. By blacking the surface of adhesion having an output value of the detection sensor 13 larger than an output value of the black ink accumulation, the output value of the adhesion becomes lower than that of the black ink accumulation. And thus it is possible to correctly distinguish between an accumulated state and an adhesion state.

In step S33, the sensor control unit 306 controls the detection sensor 13 to perform the detection operation. More specifically, the light emitting unit 201 emits light at a predetermined angle $\theta_0$ onto the ink absorber 21, and the light receiving unit 203 receives reflected light.

In step S34, the sensor control unit 306 converts an amount of light received by the light receiving unit 203 in step S33, into voltage, and outputs the voltage. The CPU 300 determines whether an output value is greater than or equal to the threshold Y(v). In a case where the output value is greater than or equal to the threshold Y(v) (YES in step S34), it is determined that the ink accumulates, and the processing proceeds to step S35. In a case where the output value is smaller than the threshold Y(v) (NO in step S34), it is determined that the ink does not accumulate, and the processing ends.

In step S35, it is determined to perform the accumulation reduction processing at a position at which the output value greater than or equal to the threshold Y(v) is detected, and the processing ends.

In the accumulation reduction processing, the clear ink is discharged to the position E by a predetermined amount similarly to the first exemplary embodiment.

(Colors of Sensor Light and Ink)

In the present exemplary embodiment, an LED emitting red sensor light is used, and the black ink is discharged before the detection operation. If sensor light with another color and an ink in a color that easily absorbs the sensor light are used, the present exemplary embodiment can be applied. The color that easily absorbs the sensor light is a color having a hue closer to a hue of a complementary color of the color of the sensor light than to an intermediate hue between the color of the sensor light and the complementary color, or an achromatic color having lightness lower than half.

For example, in a case where the color of sensor light is red, the ink color may be a color having a hue from purple blue to green yellow including cyan as a hue closer to a color of a complementary color of a color of sensor light, or an achromatic color having lightness with a value of an L-axis being less than or equal to 50 in the Commission Internationale de l'éclairage (CIE) Lab space. Among the nine types of inks in the present exemplary embodiment, the cyan ink, the light cyan ink, the black ink, and the gray ink can be applied.

With the configuration described above, an output value of a color that poorly absorbs sensor light can be decreased by discharging a black ink to a detection position before detection. It is therefore possible to prevent an ink adhesion state from being erroneously detected as an ink accumulated state.

As described in the first exemplary embodiment, it is possible to prevent erroneous detection, in a case where yellow ink adhesion might occur, by discharging a yellow ink to the position E before the detection. For example, in a case where an output value of only yellow ink adhesion out of ink adhesions is higher than an output value of ink accumulation, it is possible to correctly detect the ink accumulation and the ink adhesion without discharging the yellow ink before detection, if the yellow ink adhesion does not occur. Thus, in a third exemplary embodiment, erroneous detection is prevented by discharging the yellow ink before detection in a case where yellow ink adhesion might occur. Similarly to the second exemplary embodiment, the description of parts similar to those in the first exemplary embodiment, such as the configuration of a recording apparatus, will be omitted.

(Ink Count in Protruding Region)

Figure 16:
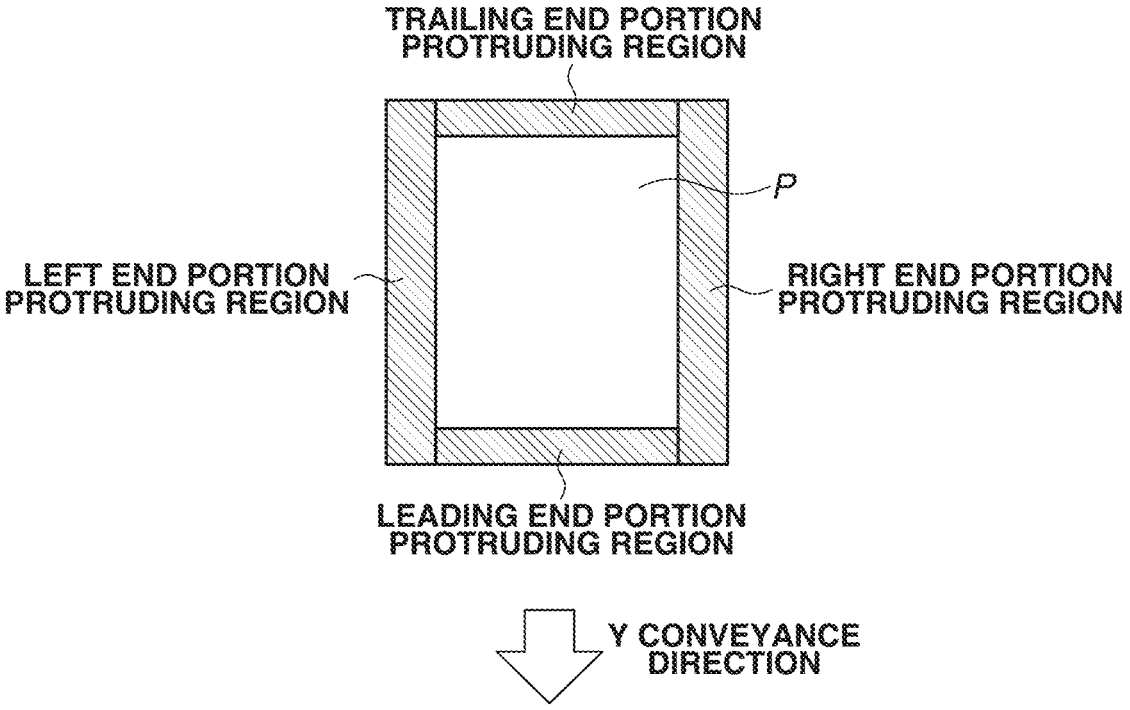
FIG. 16 is a diagram illustrating protruding regions created when marginless recording is performed according to the third exemplary embodiment.

FIG. 16 is an image diagram illustrating a region in which ink is discharged to the outside of a recording medium in a protruding manner in the marginless recording. As described above, in performing the marginless recording in the present exemplary embodiment, an image is recorded in protruding regions protruding by 3 mm from the region of the recording medium P toward a leading end portion, a trailing end portion, a right end portion, and a left end portion. The protruding regions are indicated by gray shading. If the CPU 300 receives a command of the marginless recording from the host apparatus, the CPU 300 causes the image signal processing unit 314 to generate recording data for the marginless recording, by enlarging a recording image to a size larger than the size of the recording medium. The marginless recording is performed by controlling the recording head 3 based on the recording data. By counting the number of dots of each ink in an image recorded on the 3 mm inner side of an image end portion, the number of dots discharged in a protruding region is counted. The CPU 300 counts the number of dots based on the recording data generated by the image signal processing unit 314. It is also possible to count the number of dots using another circuit. When the protruding regions are classified as the leading end portion, the trailing end portion, the right end portion, and the left end portion that are provided on the outside of the recording medium, ink discharged to the right end portion and the left end portion are respectively absorbed into the right end portion region and the left end portion region of the ink absorber 21 illustrated in FIG. 2. The number of dots in each region is counted for each color. Since the leading end and trailing end protruding regions have a wide width, each of the regions is further divided into ten, and the number of dots of each color is counted in each region. The number of dots of each color in each region is counted when an image is recorded, and the counted number of dots is stored in the ROM 301.

Figure 15:
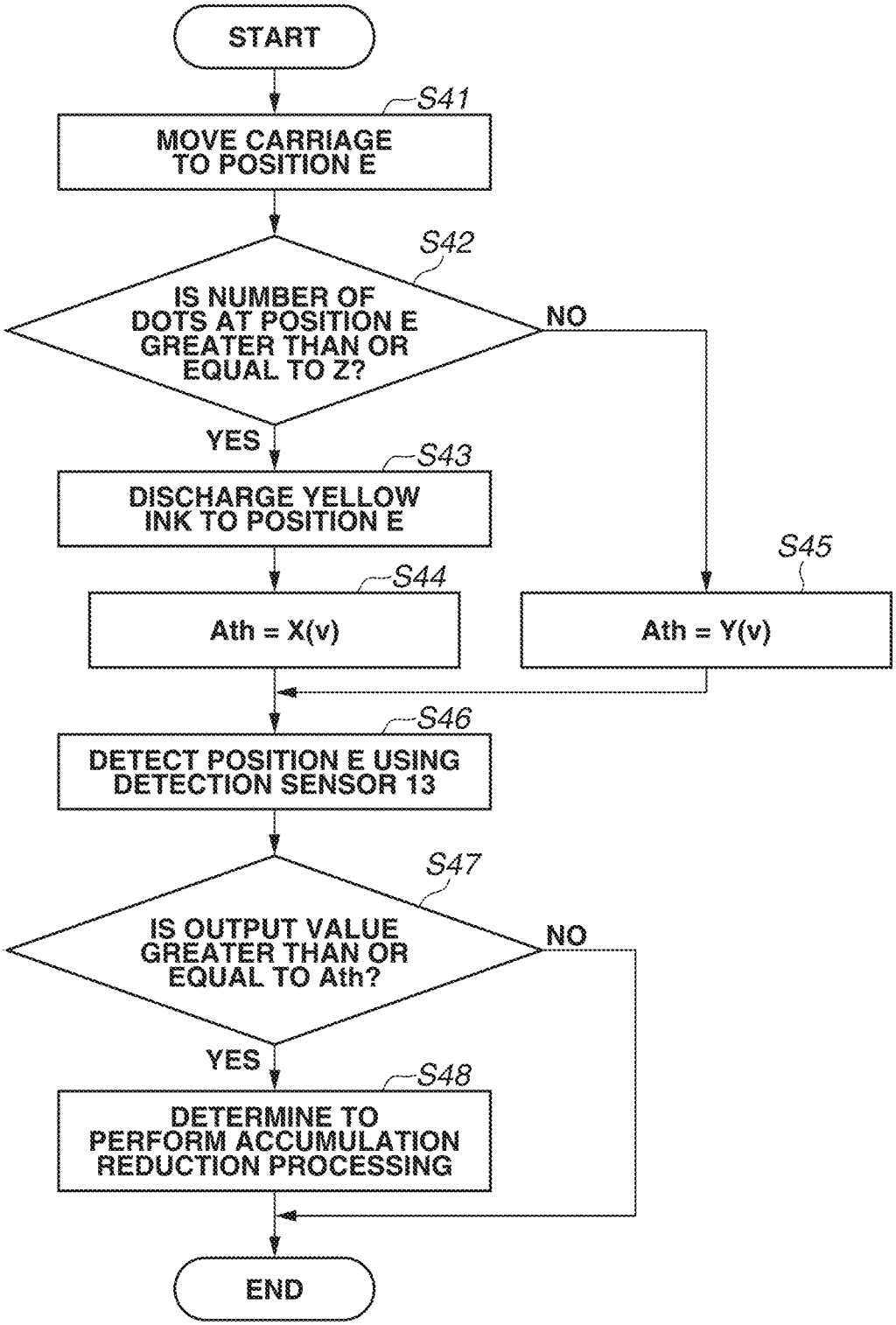
FIG. 15 is a flowchart illustrating accumulation detection processing according to a third exemplary embodiment.

FIG. 15 is a flowchart illustrating accumulation detection processing according to the third exemplary embodiment. The accumulation detection processing will be described as an operation to be performed after the marginless recording is performed. The accumulation detection processing may be performed after an operation of discharging an ink to another ink absorber 21.

In step S41, the carriage 2 is moved to the position E similarly to step S11 in the first exemplary embodiment.

In step S42, the number of dots of the yellow ink at the position E as a protruding region, which has been counted as described above, is read from the ROM 301, and it is determined whether the read number of dots is greater than or equal to Z. In a case where the number of clots of the yellow ink is greater than or equal to Z (YES in step S42), the processing proceeds to step S43. In this example, Z is a value indicating the number of dots of the yellow ink to be discharged to the ink absorber 21, and is a value at which the yellow ink adhesion might occur. In a case where the number of dots of the yellow ink is less than Z (NO in step S42), the processing proceeds to step S45.

In step S43, 500 droplets of the yellow ink are discharged for erroneous detection prevention. In step S44, a threshold is set to Ath=X(v), and the processing proceeds to the detection operation in step S46. Similarly to the first exemplary embodiment, the threshold X(v) is a threshold for distinguishing between accumulation and adhesion when a yellow ink is discharged before detection.

In a case where the number of dots of yellow ink is less than Z (NO in step S42), it is determined that the ink absorber 21 is not soiled by the yellow ink. In step S45, the threshold is set to Y(v) without discharging a yellow ink, and then, the processing proceeds to the detection operation in step S46. As the threshold Y(v), a value between an output value of adhesion of an ink in a color other than yellow and an output value of black ink accumulation can be set.

In step S46, the sensor control unit 306 controls the detection sensor 13 to perform the detection operation at the position E.

In step S47, the sensor control unit 306 converts an amount of light received by the light receiving unit 203 in step S46, into voltage, and outputs the voltage. It is then determined whether an output value is greater than or equal to the set threshold Ath. In a case where the output value is less than the threshold Ath (NO in step S47), the processing ends. In a case where the output value is greater than or equal to the threshold Ath (YES in step S47), it is determined to perform the accumulation reduction processing in step S48, and the processing ends. In a case where it is determined in step S48 to perform the accumulation reduction processing, the clear ink is discharged to the position E by a predetermined amount after accumulation detection.

In the present exemplary embodiment, the number of dots is counted. Alternatively, z may be set based on a proportion. For example, it may be determined whether a proportion of yellow in each color is greater than or equal to a predetermined value.

In addition, in a case where an output value obtained by adhesion of an ink other than the yellow ink becomes higher than an output value at which ink accumulation is detected, it may be determined whether to discharge the yellow ink to the position E before detection by counting the number of dots of the other ink in that color. Based on the total number of dots of inks in a plurality of colors having higher output values of ink adhesion than an output value at which ink accumulation is detected, it may be determined whether the yellow ink is discharged to the position E before the detection processing is performed.

As described above, in the present exemplary embodiment, the yellow ink is discharged before detection only when necessary by counting the number of dots of the yellow ink in the protruding region. Thus, ink consumption can be suppressed.

In a fourth exemplary embodiment, the description will be given of a configuration in which detection processing can be performed even in a case where a remaining amount of an ink to be discharged before the detection operation is performed is small. Also in the present exemplary embodiment, the description of parts similar to those in the above-described exemplary embodiments, such as the configuration of a recording apparatus, will be omitted.

Figure 17:
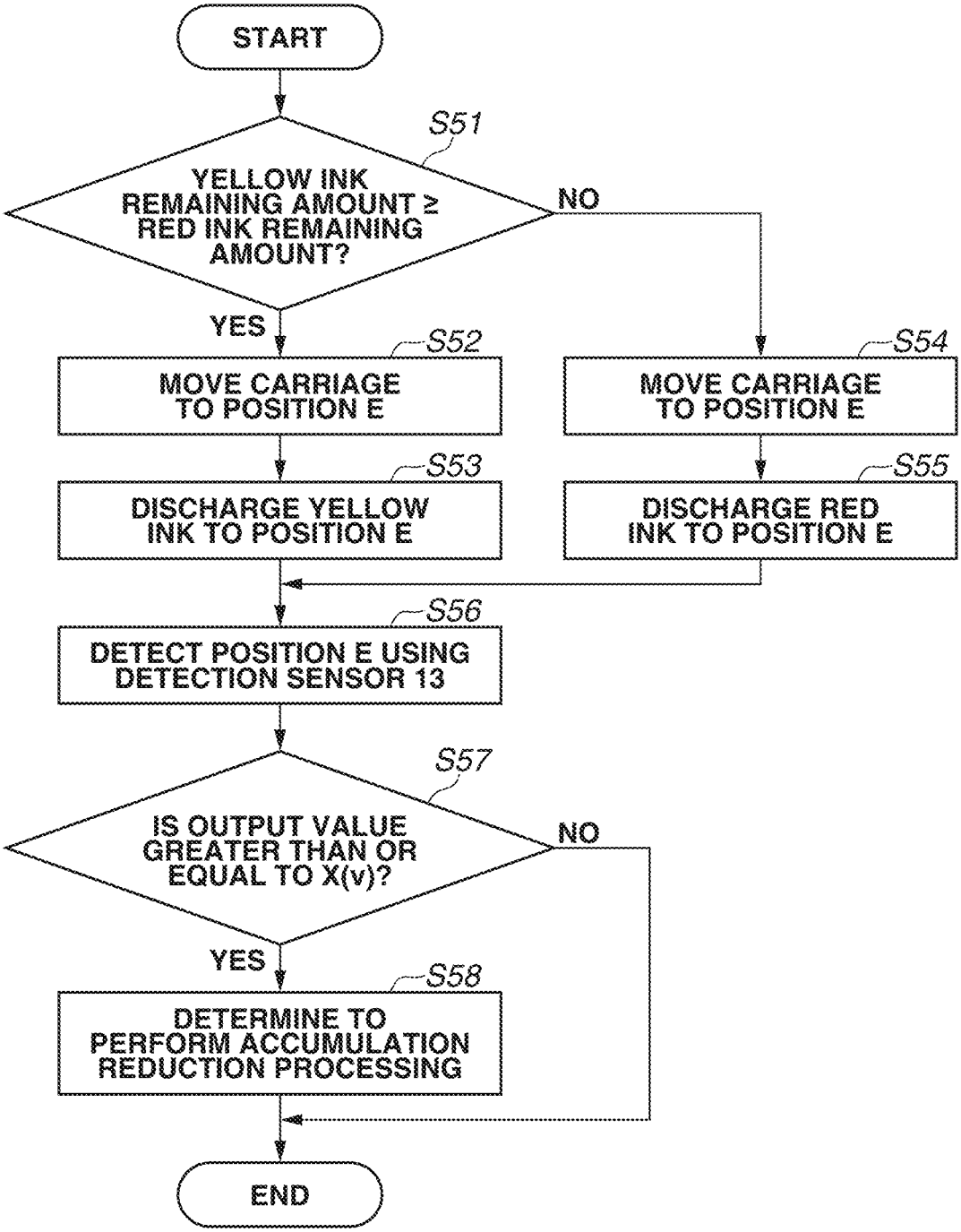
FIG. 17 is a flowchart illustrating accumulation detection processing according to a fourth exemplary embodiment.

FIG. 17 is a flowchart illustrating detection processing according to the fourth exemplary embodiment.

In step S51, the CPU 300 compares ink remaining amounts in ink tanks of the yellow ink and the red ink that are stored in the ink tank remaining amount management unit 313. In a case where the remaining amount of the yellow ink is greater than or equal to the remaining amount of the red ink (YES in step S51), the processing proceeds to step S52. In a case where the remaining amount of the red ink is greater (NO in step S51), the processing proceeds to step S54.

In step S52 or S54, similarly to step S11 in the first exemplary embodiment, the carriage 2 is moved to the position E. When the movement ends, the processing proceeds to step S53 or S55, respectively.

In step S53, similarly to step S12 in the first exemplary embodiment, the yellow ink is discharged to the position E. In step S55, the red ink is discharged to the position E. When the discharge ends, the processing proceeds to step S56 from both steps.

In steps S56 to S58, processing similar to that performed in steps S13 to S15 in the first exemplary embodiment is performed. In step S56, the sensor control unit 306 controls the detection sensor 13 to perform the detection operation. In step S57, the sensor control unit 306 converts an amount of light received by the light receiving unit 203 in step S56, into voltage, and outputs the voltage. The CPU 300 determines whether an output value is greater than or equal to the threshold X(v). In a case where the output value is greater than or equal to the threshold X(v) (YES in step S57), it is determined that an ink accumulates, and the processing proceeds to step S58. In a case where the output value is smaller than the threshold X(v) (NO in step S57), it is determined that an ink does not accumulate, and the processing ends.

In step S58, it is determined to perform the accumulation reduction processing on the position E, and the processing ends. In a case where it is determined in step S58 to perform the accumulation reduction processing, the clear ink is discharged to the position E by a predetermined amount after the accumulation detection processing ends.

According to the present exemplary embodiment, when an ink is discharged to the position E before the detection, even in a case where a remaining amount of the yellow ink is small, the processing can be performed and erroneous detection can be prevented by discharging the red ink in a color that does not absorb red LED light from an alternative sensor.

In the above-described exemplary embodiments, the recording apparatus that performs recording by the recording head moving has been described. In a fifth exemplary embodiment, the description will be given of a full-line recording apparatus. In the full-line recording apparatus, discharge ports are arranged over the width range of a recording medium, and recording is performed by discharging an ink from a stationary recording head onto the conveyed recording medium. Also in the present exemplary embodiment, the description of parts similar to those in the above-described exemplary embodiments, such as the configuration of a recording apparatus, will be omitted.

Figure 18:
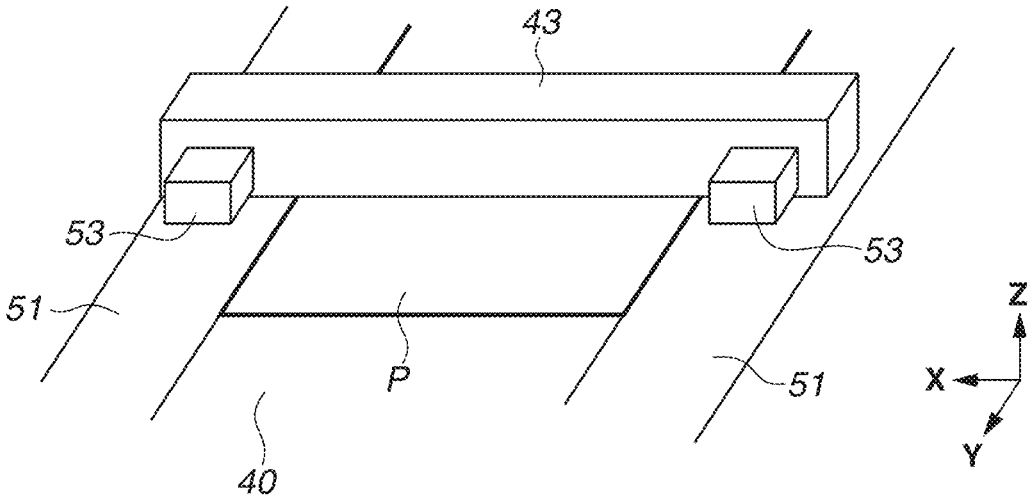
FIG. 18 is a perspective view illustrating a recording apparatus according to a fifth exemplary embodiment.

FIG. 18 is a schematic diagram illustrating an interior portion of the full-line recording apparatus. In place of the platen, the recording medium P is supported by a conveyance belt 40. In a recording head 43, a discharge port array including discharge ports for discharging nine types of inks that are arranged in a width Y direction of the recording medium P is arranged. The recording is performed by discharging inks from the stationary recording head 43 while the conveyance belt 40 conveying the recording medium P. In the conveyance belt 40, an ink absorber 51 is provided in a portion to which an ink is discharged in the marginless recording. Two detection sensors 53 are provided in the Y direction of the recording head 43, and each include a light emitting unit and a light receiving unit. The detection sensor 53 can detect a position at which the ink is discharged onto the ink absorber 51 in the marginless recording.

Figure 19:
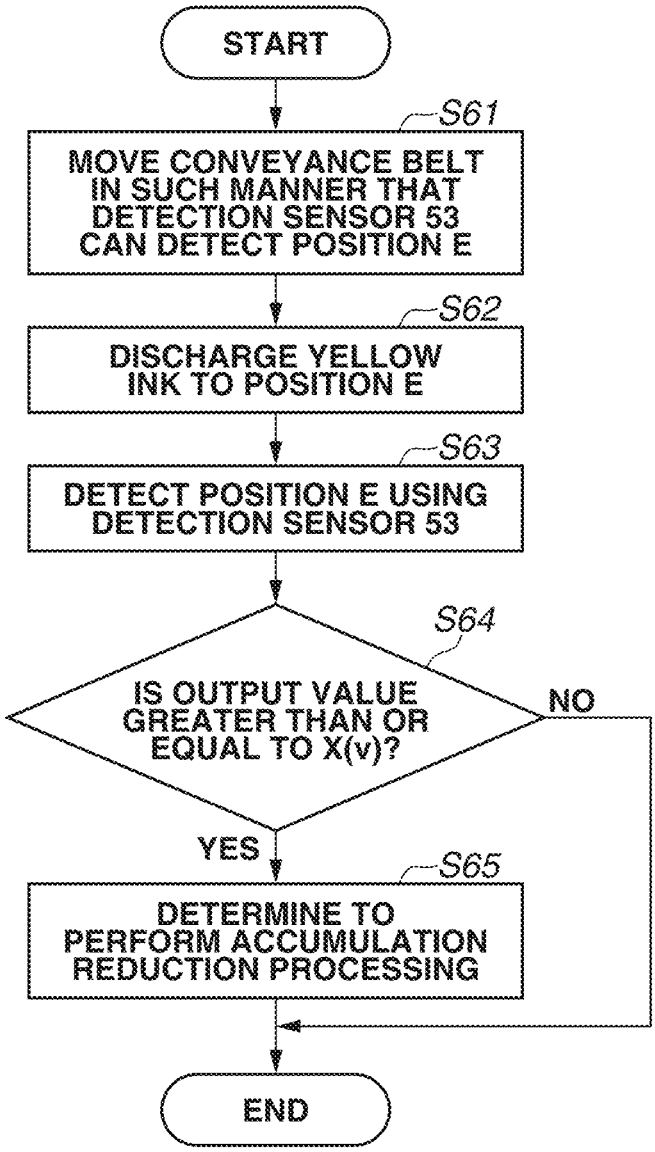
FIG. 19 is a flowchart illustrating accumulation detection processing according to the fifth exemplary embodiment.

FIG. 19 is a flowchart illustrating accumulation detection processing according to the fifth exemplary embodiment. The processing is started after the marginless recording is executed.

In step S61, the position E at which the ink is discharged onto the ink absorber 51 in the marginless recording is moved by the conveyance belt 40 to a position that can be detected by the detection sensor 53.

In steps S62 to S65, processing similar to that performed in steps S12 to S15 in the first exemplary embodiment is performed. In step S62, the yellow ink is discharged by the recording head 43 to the position E. In step S63, the detection sensor 53 detects the position E. In step S64, it is determined whether an output value obtained in step S63 is greater than or equal to the threshold X(v). If the output value is greater than or equal to the threshold X(v) (YES in step S64), it is determined to perform the accumulation reduction processing in step S65. If the output value is less than the threshold X(v) (NO in step S64), the processing ends. In the accumulation reduction processing, an accumulated ink is absorbed into the ink absorber 51 by discharging a clear ink to the position E by a predetermined amount.

As described above, also in the full-line recording apparatus, the accumulation detection processing can be performed.

According to an exemplary embodiment of the present disclosure, it is possible to prevent erroneous detection of an ink accumulated state by discharging an ink in a predetermined color to a position at which an accumulated state is to be detected, before an accumulated state is detected.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-221730, filed Nov. 27, 2018, which is hereby incorporated by reference herein in its entirety.

What is claimed is:

1. A recording apparatus comprising:

a recording unit configured to discharge a plurality of inks in different colors;

an ink absorber configured to absorb the plurality of inks discharged from the recording unit;

a detection unit including a light emitting unit configured to emit light onto a predetermined position on the ink absorber, and a light receiving unit configured to receive light reflected from the predetermined position on the ink absorber; and a control unit configured to control the detection unit to perform a detection operation in which the light emitting unit emits light onto the predetermined position, and the light receiving unit receives light reflected from the predetermined position on the ink absorber, wherein the recording unit discharges an ink in a first color that is a chromatic color among the plurality of inks to the predetermined position based on decision to execute the detection operation by the detection unit, and controls the detection unit to perform the detection operation after the recording unit has discharged the ink in the first color to the predetermined position.

2. The recording apparatus according to claim 1, wherein the recording unit does not discharge an ink to the predetermined position during a period from when the recording unit discharges the ink in the first color to the predetermined position through an end of the detection operation.

3. The recording apparatus according to claim 2, wherein, based on decision to execute the detection operation by the detection unit, the control unit acquires information regarding a position amount of ink in a second color to be discharged to the predetermined position by the recording unit, where the second color is a color having a hue that is closer to a hue of a color of light emitted by the light emitting unit, than to an intermediate hue between the color of the emitted light and a complementary color of the color of the emitted light, and, based on the acquired information, (i) the recording unit discharges the ink in the first color to the predetermined position in a case where an amount of ink in the second color is greater than or equal to a predetermined amount, and (ii) the recording unit does not discharge the ink in the first color to the predetermined position in a case where the amount of ink in the second color is smaller than the predetermined amount.

4. The recording apparatus according to claim 3, wherein the control unit acquires information regarding an outside amount of ink in the second color to be discharged to an outside of a recording medium by the recording unit, in marginless recording that records up to an end of the recording medium by discharging an ink to the ink absorber on the outside of the recording medium when performing recording at the end of the recording medium.

5. The recording apparatus according to claim 3, wherein the ink in the first color and the ink in the second color are inks in the same color.

6. The recording apparatus according to claim 1, wherein the control unit performs the detection operation after an end of marginless recording that records up to an end of a recording medium by discharging an ink up to an outer region of the recording medium.

7. The recording apparatus according to claim 6, wherein the predetermined position on the ink absorber is a position at which an ink is discharged to an outside of the recording medium in the marginless recording.

8. The recording apparatus according to claim 1, wherein the recording unit performs preliminary discharge of an ink to a position on an outside of a recording medium such that the preliminary discharge does not affect recording of an image on the recording medium, and wherein the predetermined position on the ink absorber is a position at which an ink is discharged by the preliminary discharge.

9. The recording apparatus according to claim 1, wherein the first color further is a color having a hue closer to a hue of a color of light emitted by the light emitting unit than to an intermediate hue between the color of the emitted light and a complementary color of the color of the emitted light.

10. The recording apparatus according to claim 9, wherein a color of light emitted by the light emitting unit is red, and the first color further is a color having a hue from purple to yellow including red.

11. The recording apparatus according to claim 1, wherein the first color further is a color having a hue closer to a hue of a complementary color of a color of light emitted by the light emitting unit than to an intermediate hue between the color of the emitted light and the complementary color of the color of the emitted light, or an achromatic color having a value of an L-axis being less than or equal to 50 in a Commission Internationale de l'éclairage (CIE) Lab space.

12. The recording apparatus according to claim 1, wherein the recording unit can discharge inks in a plurality of colors being colors having a hue closer to a hue of a color of light emitted by the light emitting unit than to an intermediate hue between the color of the emitted light and a complementary color of the color of the emitted light, and wherein the control unit controls the recording unit to discharge ink which is largest remaining amount of ink among the inks in the plurality of colors, before the detection operation.

13. The recording apparatus according to claim 1, wherein a surface at the predetermined position on the ink absorber is smoother when the ink in the first color accumulates than when the ink in the first color does not accumulate.

14. The recording apparatus according to claim 1, wherein a color of a surface of the ink absorber is a color that absorbs light emitted by the light emitting unit more than the first color.

15. The recording apparatus according to claim 1, wherein the plurality of inks includes a pigment ink.

16. The recording apparatus according to claim 1, further comprising a determination unit configured to determine whether to perform a predetermined operation related to ink accumulation on the ink absorber based on an amount of light received by the light receiving unit from the predetermined position on the ink absorber.

17. The recording apparatus according to claim 16, wherein, in a case where the amount of light received by the light receiving unit from the predetermined position on the ink absorber is greater than or equal to a predetermined threshold, the determination unit determines to perform the predetermined operation related to ink accumulation on the ink absorber.

18. The recording apparatus according to claim 16, wherein the amount of light received by the light receiving unit from the predetermined position on the ink absorber and used in the determination by the determination unit is that amount emitted from the light emitting unit onto the predetermined position and reflected at a specularly-reflected position to be received by the light receiving unit.

19. The recording apparatus according to claim 16, wherein the control unit controls a notification unit to make a notification for prompting a user to clean the ink absorber, as the predetermined operation, in accordance with determination of performing the predetermined operation.

20. The recording apparatus according to claim 16, wherein the recording unit includes a first discharge port for discharging a first ink that accumulates on the ink absorber, and a second discharge port for discharging a second ink that is less likely to accumulate on the ink absorber than the first ink, and wherein, in accordance with determination, the recording unit discharges, as the predetermined operation and to the predetermined position, an ink that is less likely to accumulate on the ink absorber.

21. The recording apparatus according to claim 20, wherein the first ink is an ink having a higher pigment concentration than the second ink.

22. The recording apparatus according to claim 1, wherein the recording unit does not discharge an ink to the predetermined position during a period from when the recording unit discharges the ink in the first color to the predetermined position through an end of the detection operation.

23. A recording apparatus comprising:

an ink absorber configured to absorb an ink;

a recording unit including a discharge port to discharge a first ink that accumulates on the ink absorber;

a detection unit including a light emitting unit configured to emit light onto a predetermined position on the ink absorber, and a light receiving unit configured to receive light reflected from the predetermined position on the ink absorber; and a control unit configured to control the detection unit to perform a detection operation in which the light emitting unit emits light onto the predetermined position, and the light receiving unit receives light reflected from the predetermined position on the ink absorber and based on a received light amount, control the recording unit to apply, onto the predetermined position, a second ink that is less likely to accumulate on the ink absorber than the first ink, wherein the recording unit discharges an ink in a first color that is a chromatic color to the predetermined position based on decision to execute the detection operation by the detection unit, and controls the detection unit to perform the detection operation after the ink in the first color has been discharged to the predetermined position.

24. The recording apparatus according to claim 23, wherein the control unit controls the recording unit not to discharge an ink to the predetermined position during a period from when the recording unit discharges the ink in the first color to the predetermined position through an end of the detection operation.

25. The recording apparatus according to claim 23, wherein, based on decision to execute the detection operation by the detection unit, the control unit acquires information regarding a position amount of ink in a second color to be discharged to the predetermined position by the recording unit, where the second color is a color having a hue that is closer to a hue of a color of light emitted by the light emitting unit, than to an intermediate hue between the color of the emitted light and a complementary color of the color of the emitted light, and, based on the acquired information, (i) the recording unit discharges the ink in the first color to the predetermined position in a case where an amount of ink in the second color is greater than or equal to a predetermined amount, and (ii) the recording unit does not discharge the ink in the first color to the predetermined position in a case where the amount of ink in the second color is smaller than the predetermined amount.

26. A method in a recording apparatus, the method comprising:

receiving, by a light receiving unit, reflected light from a predetermined position on an ink absorber to which a plurality of inks in different colors is to be discharged from a recording unit; and applying an ink in a first color that is a chromatic color among the plurality of inks from the recording unit to the predetermined position, before execution of the receiving the reflected light.

27. The method according to claim 26, the method further comprising determining whether to cause the recording apparatus to perform a predetermined operation, based on a received light amount at the light receiving unit, wherein applying includes applying the ink in the first color among the plurality of inks from the recording unit to the predetermined position, before execution of the receiving the reflected light for the determining.

28. The method according to claim 26, wherein the recording unit does not discharge an ink to the predetermined position during a period from when the recording unit discharges the ink in the first color to the predetermined position through an end of the detection operation.

29. The method according to claim 26, wherein, in a case where the recording unit applies the ink in the first color to the predetermined position, acquiring information regarding a position amount of ink in a second color to be discharged to the predetermined position by the recording unit, where the second color is a color having a hue that is closer to a hue of a color of emitted light than to an intermediate hue between the color of the emitted light and a complementary color of the color of the emitted light, and, based on the acquired information, (i) the recording unit discharges the ink in the first color to the predetermined position in a case where an amount of ink in the second color is greater than or equal to a predetermined amount, and (ii) the recording unit does not discharge the ink in the first color to the predetermined position in a case where the amount of ink in the second color is smaller than the predetermined amount.

30. A recording apparatus comprising:

a recording unit configured to discharge a plurality of inks in different colors;

an ink absorber configured to absorb the plurality of inks discharged from the recording unit;

a sensor configured to sense a predetermined position on the ink absorber; and a control unit configured to control the sensor to perform a detection operation for detecting ink accumulation on the ink absorber by sensing the predetermined position on the ink absorber, wherein the recording unit discharges an ink in a first color that is a chromatic color among the plurality of inks to the predetermined position based on decision to execute the detection operation, and controls the sensor to perform the detection operation after the recording unit has discharged the ink in the first color.

* * * * *